US005797063A

United States Patent [19]

Umezawa et al.

[11] Patent Number: 5,797,063

[45] Date of Patent: Aug. 18, 1998

[54] IMAGE FORMING APPARATUS AND CLEANING DEVICE FOR TRANSFER MATERIAL CONVEYOR BELT

[75] Inventors: Nobuhiko Umezawa, Yokohama; Harumitsu Mashiko, Tokyo, both of Japan

[73] Assignee: Ricoh Company, Ltd., Tokyo, Japan

[21] Appl. No.: 801,121

[22] Filed: Feb. 14, 1997

[30] Foreign Application Priority Data

| | | | |
|---|---|---|---|
| Feb. 17, 1996 | [JP] | Japan | 8-053906 |
| Feb. 20, 1996 | [JP] | Japan | 8-031828 |
| Mar. 29, 1996 | [JP] | Japan | 8-103694 |
| Sep. 3, 1996 | [JP] | Japan | 8-252446 |

[51] Int. Cl.[6] ..... G03G 21/00

[52] U.S. Cl. ..... 399/34; 399/101; 399/352; 198/494; 198/810.01

[58] Field of Search ..... 399/71, 101, 348, 399/352, 34, 299, 303, 312; 15/208, 230, 230.16; 198/810.01, 810.02, 494; 474/92

[56] References Cited

U.S. PATENT DOCUMENTS

| | | | |
|---|---|---|---|
| 3,975,096 | 8/1976 | Opravil | 399/352 |
| 4,110,035 | 8/1978 | Kamata | 399/352 |
| 4,568,174 | 2/1986 | Stange | 399/352 |
| 4,862,221 | 8/1989 | Tabuchi et al. | 399/352 |
| 5,057,873 | 10/1991 | Sawai et al. | 399/303 |
| 5,075,733 | 12/1991 | Weissberger et al. | 399/352 |
| 5,390,602 | 2/1995 | Gorl | 101/425 |
| 5,500,723 | 3/1996 | Godlove | 399/34 |
| 5,506,669 | 4/1996 | Inoue et al. | 399/71 |

FOREIGN PATENT DOCUMENTS

| | | |
|---|---|---|
| 3-181981 | 8/1991 | Japan . |
| 5-061369 | 3/1993 | Japan . |
| 5-142973 | 6/1993 | Japan . |

*Primary Examiner*—Robert Beatty

*Attorney, Agent, or Firm*—Oblon, Spivak, McClelland, Maier & Neustadt, P.C.

[57] ABSTRACT

In an image forming apparatus, a cleaning device using a webbing is capable of surely removing stains firmly adhered to a desired surface to be cleaned. Even when the degree and the kind of contamination on the above surface is irregular due to the varying operating condition of the apparatus, the cleaning device is operable in a desirable manner. The cleaning device includes a webbing pressed against the surface to be cleaned and a pressing member having a plurality of projections with edge portions at the ends of the projections and wherein at least two of the projections are in the cleaning range at any one time. In a preferred embodiment, the cleaning device is provided in an image forming apparatus and cleans a conveyor belt for conveying a recording medium to which a toner image is to be transferred. Additionally, a controller in the image forming apparatus operates the cleaning device on the basis of the degree of contamination sensed by a sensor, to clean the surface a greater number of times at initial power up or controls the cleaning device to exert a greater force during recovery after an operational error.

19 Claims, 17 Drawing Sheets

IMAGE FORMING APPARATUS AND CLEANING DEVICE FOR TRANSFER MATERIAL CONVEYOR BELT

BACKGROUND OF THE INVENTION

The present invention relates to a copier, facsimile apparatus, printer or similar electrophotographic image forming apparatus and, more particularly, to a cleaning device for an image forming apparatus and of the type using a webbing.

A cleaning device for the above application has been proposed in various forms in the past. One of them uses a webbing implemented by unwoven cloth or tissue paper by way of example. The webbing is pressed against a desired surface to be cleaned by, e.g., a presser member. While the desired surface and the webbing are moved relative to each other, the webbing removes deposits or contamination from the surface. This type of cleaning device has the following advantages. The deposits can be collected without resorting to a large scale collecting unit. The device is applicable even to liquid stains and prevents the stains from flying about. Further, the device allows the collected deposits to be easily disposed of only if the webbing is replaced. With these advantages, the cleaning device is attracting increasing attention in relation to a photoconductive drum and a conveyor belt included in an electrophotographic image forming apparatus.

For example, Japanese Patent Laid-Open Publication No. 3-196083 discloses a cleaning device including a webbing consisting of fibers as thin as less than 15 μm at least at a portion of the webbing contacting an image carrier. Japanese Patent Laid-Open Publication No. 3-196084 teaches a cleaning device including a webbing having, at least at the above portion, a maximum surface roughness, minimum surface roughness and mean surface roughness which are commonly above 0.2 μm, but below 20 μm. In any case, the webbing has fine projections and recesses on its surface and thereby allows a minimum of toner, paper dust and other fine impurities to pass through the webbing. This promotes the desirable cleaning of the surface of the image carrier.

However, with the conventional cleaning devices of the type using a webbing, it is likely that deposits or contamination firmly adhered to the surface to be cleaned is not removed.

One of conventional image forming apparatuses with the webbing type cleaning device includes a conveyor belt for conveying a recording medium to an image transfer position facing an image carrier. In this kind of apparatus, the webbing removes a liquid developer deposited on the conveyor belt. Again, the webbing it apt to fail to surely remove deposits firmly adhered to the conveyor belt.

In the image forming apparatus using the webbing to clean the conveyor belt, the degree (adhesion) and the kind of contamination of the belt depends on the varying operation condition of the apparatus. It is therefore likely that not all the degrees and kinds of contamination can be removed by the webbing in a desirable manner. Generally, the contamination of the conveyor belt occurs in the following three different conditions of the operation of the apparatus.

(1) The liquid developer deposited on the image carrier is transferred to the belt by way of a usual image transfer process. For example, a control image formed on the image carrier for checking, e.g., potential or the amount of toner on the image carrier may be transferred to the belt, or when the developer accidentally deposited on the image carrier outside of an image forming area may be transferred to the belt.

(2) When an image forming operation under way is interrupted due to a jam, door opening or similar error, the developer may be deposited on the belt. In this case, the developer or liquid deposits in an amount great enough to wet the belt although its toner content is low.

(3) When the belt contaminated by the developer is left unused over a long period of time, the liquid of the developer evaporates with the result that only dry substances including toner firmly adhere to the belt.

Because such contamination on the belt differs in degree (adhesion) and kind, the conventional cleaning device using the webbing is apt to fail to fully remove it. For example, in the above case (1), because cleaning is effected while image formation is under way, the belt should preferably be passed through the cleaning position only once. However, this is apt to fail to clean the belt to a degree high enough for the belt to be prepared for the next image formation. In the case (2), because the webbing is easy to wet due to the great amount of liquid, it is likely to fail to clean the belt to a dry state. Further, in the case (3), the adhesion of the contamination to the belt is too intense to be removed by the usual cleaning operation.

The cleaning devices taught in the previously mentioned Japanese Patent Laid-Open Publications are applicable to an image forming apparatus of the type described. However, if the same cleaning operation is maintained without regard to the degree or the kind of contamination, the cleaning devices again fail to exhibit a desirable cleaning ability.

SUMMARY OF THE INVENTION

It is therefore an object of the present invention to provide a cleaning device using a webbing and capable of surely removing stains firmly adhered to a surface to be cleaned, and an image forming apparatus having the same.

It is another object of the present invention to provide an image forming apparatus with a cleaning device using a webbing, and capable of surely cleaning the surface of a conveyor belt even when the degree and the kind of contamination on the surface is irregular due to the varying operating condition of the apparatus.

In accordance with the present invention, a cleaning device for cleaning a desired surface has a webbing pressed against the desired surface and movable relative to the desired surface, and a presser member for pressing the webbing against the desired surface with a contact surface thereof.

Also, in accordance with the present invention, a cleaning device for cleaning a desired surface includes a webbing pressed against the desired surface and movable relative to the desired surface. A rotatable presser member in a form of a roller has ridges on its outer periphery. The presser member presses the webbing against the desired surface with its outer periphery. A conveying mechanism conveys the webbing.

Further, in accordance with the present invention, an image forming apparatus includes a conveyor belt for conveying a recording medium to which a toner image is to be transferred from an image carrier, to an image transfer position facing the surface of the image carrier. A cleaning device cleans the surface of the conveyor belt. The cleaning device has a webbing pressed against the surface of the conveyor belt and movable relative to the surface, and a presser member for pressing the webbing against the surface of the conveyor belt with its contact surface.

Furthermore, in accordance with the present invention, an image forming apparatus includes a conveyor belt for conveying a recording medium to which a toner image is to be transferred from an image carrier, to an image transfer position facing the surface of the image carrier. A cleaning device cleans the surface of the conveyor belt. The cleaning device has a webbing pressed against the surface of the conveyor belt and movable relative to the surface, and a rotatable presser member in the form of a roller having ridges on its outer periphery. The presser member presses the webbing against the surface of the conveyor belt with its outer periphery. A conveying mechanism conveys the webbing.

Moreover, in accordance with the present invention, an image forming apparatus includes a conveyor belt for conveying a recording medium to which a toner image is to be transferred from an image carrier, to an image transfer position facing the surface of the image carrier. A cleaning device cleans the surface of the conveyor belt by pressing a webbing against the surface and based on the relative movement of the surface and webbing. A controller controls the cleaning operation of the cleaning device in accordance with the operating condition of the image forming apparatus.

In addition, in accordance with the present invention, an image forming apparatus includes a conveyor belt for conveying a recording medium to which a toner image is to be transferred from an image carrier, to an image transfer position facing the surface of the image carrier. A cleaning device cleans the surface of the conveyor belt by pressing a webbing against the surface and based on the relative movement of the surface and webbing. A sensor senses the degree of contamination of the surface. A controller controls the cleaning device on the basis of the degree of contamination sensed by the sensor.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
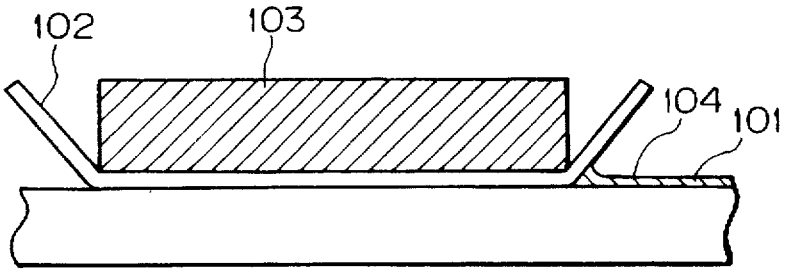
Fig. 1 PRIOR ART
FIG. 1 is a sectional front view showing a conventional cleaning device using a webbing.

To better understand the present invention, a brief reference will be made to a conventional cleaning device using a webbing, shown in FIG. 1. As shown, the cleaning device includes a presser member 103 for pressing a webbing, e.g., unwoven cloth or tissue paper 102 against a surface 101 to be cleaned. A stain 104 deposited on the surface 101 is wiped off by the relative movement of the surface 101 and the webbing 102. Generally, while the webbing and presser member 103 are so positioned as not to move relative to each other, the surface 101 is moved relative to the webbing 102. A spring, for example, is often used to bias the presser member 103 for thereby exerting a pressure on the surface 101. The contamination 104 wiped off by the webbing 102 is absorbed by the webbing and collected thereby.

The cleaning device of the type described has various advantages, as follows. The stain can be collected without resorting to a large scale collecting unit. The device is applicable even to liquid stains and prevents them from flying about. Further, the device allows the collected deposits to be easily disposed of only if the webbing is replaced. However, with the conventional cleaning device, it is likely that deposits firmly adhered to the cleaning surface cannot be fully wiped off, as discussed earlier.

Preferred embodiments of the present invention will be described hereinafter which are free from the above problem.

1st Embodiment

Figure 2:
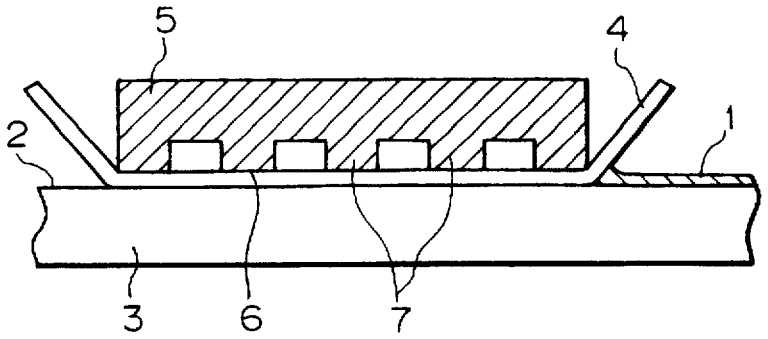
FIG. 2 is a sectional front view showing a first embodiment of the present invention.
Figure 3:
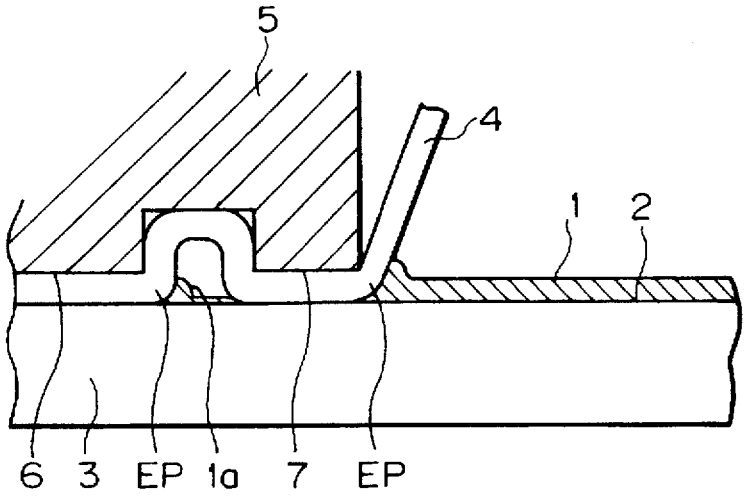
FIG. 3 is a sectional enlarged front view showing a portion of the first embodiment for removing contamination from a surface to be cleaned.

Referring to FIGS. 2 and 3, a cleaning device embodying the present invention is shown. As shown, the cleaning device includes a presser member 5 for pressing a webbing 4 against the surface 2 of an object to be cleaned. A spring or similar biasing means, not shown, constantly biases the presser member 5 against the surface 2. The webbing 4 and presser member 5 are movable relative to the webbing 2. The force of the biasing means is selected such that the webbing 4 and pressure member 5 are not displaced relative to each other.

The presser member 5 has a contact surface 6 to contact the surface 2 of the object 3. The contact surface 6 is formed with a plurality of projections 7. The projections 7 each extends in the direction perpendicular to the direction in which the webbing 4 and presser member 5 and the surface 2 move relative to each other.

In operation, the webbing 4 and presser member 5 move relative to the surface 2, wiping off a stain 1. The stain or deposits 1 removed from the surface 2 are absorbed by the webbing 4 and collected thereby. At this instant, the portions of the webbing 4 corresponding to eh projections 7 of the presser member 5 have an edge-like configuration each. The edge-like portions, labeled EP, peel off the stain 1 firmly adhered to the surface 2. In this manner, even the stain 1 firmly adhered to the surface 2 can be fully removed.

The edge-like portions EP of the webbing 4 correspond in number to the projections 7 of the presser member 5, as shown in FIG. 3. Therefore, a stain 1*a* not removed by any one of the edge-like portions EP can be removed by the following edge-like portions EP. This further enhances the cleaning ability of the cleaning device.

2nd Embodiment

A reference will be made to FIGS. 4–7 for describing a second embodiment of the present invention. This embodiment is applied to a color laser printer by way of example and used to clean a conveyor belt.

Figure 4:
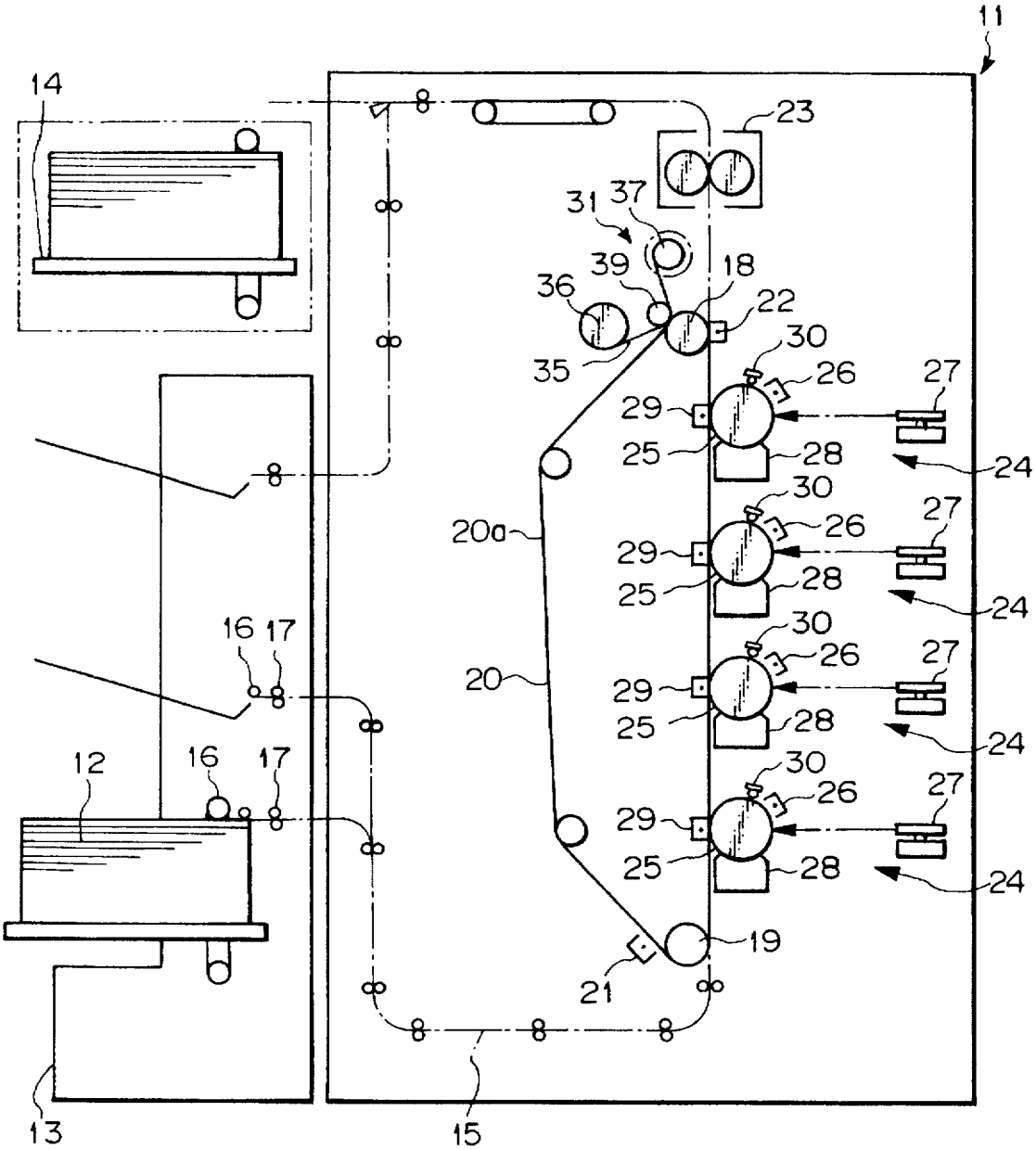
FIG. 4 is a sectional front view of a color laser printer to which a cleaning device in accordance with a second embodiment is applied.

As shown in FIG. 4, a color laser printer, generally 11, includes a sheet transport path extending from a sheet feed section 13 to a sheet discharge section 14. The sheet feed section 13 is loaded with a stack of sheets or recording media 12 and has a pick-up roller 16 and a sheet separating mechanism 17. After the pick-up roller 16 has picked up the uppermost sheet 12, the separating mechanism 17 separates the sheet 12 and feeds it. The separating mechanism is implemented by two cooperative rollers. The sheet transport path 15 includes a conveyor belt 20 passed over a drive roller 18 and a driven roller 19. The drive roller 18 is driven by a drive source, not shown. A charger 21 is located at the upstream side of the path 15 for charging the belt 20 while a discharger 22 is located at the downstream side of the path 15 for discharging the belt 20. Specifically, the belt 21 electrostatically retains the sheet 12 thereon due to the charge of the charger 21, and then releases it due to the discharge of the discharger 22. A fixing unit 23 is positioned on the path 15 downstream of the belt 20 in order to fix a toner image transferred from the belt 21 to the sheet 12.

Four electrophotographic process sections 24 are sequentially arranged along the belt 20 and respectively assigned to yellow, magenta, cyan, and black. The process sections 24 each has an image carrier in the form of a photoconductive drum 25 contacting the belt 20, and a main charger 26, optics 27 for exposure, a developing unit 28, an image transfer unit 29 and a discharger 30 sequentially arranged around the drum 25. In operation, the charger 26 charges the surface of the drum 25 uniformly. The optics 27 scans the charged surface of the drum 25 with a laser beam in order to from a latent image thereon. The developing unit 28 develops the latent image with toner stored therein, thereby forming a corresponding toner image. The image transfer unit 29 transfers the toner image from the drum 25 to the sheet 12 contained on the belt 20. In the illustrative embodiment, the laser printer 11 is of the type developing the latent image with a liquid developer. Therefore, each developing unit 28 stores a developer containing toner particles having a diameter of about 1 μm.

Figure 5:
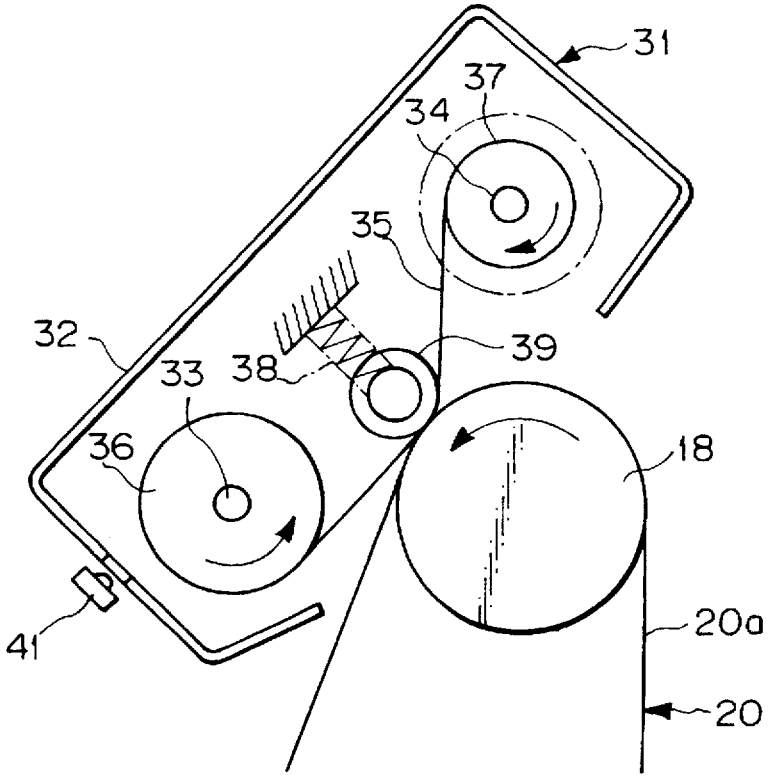
FIG. 5 is a sectional front view of the cleaning device shown in FIG. 4.
Figure 6:
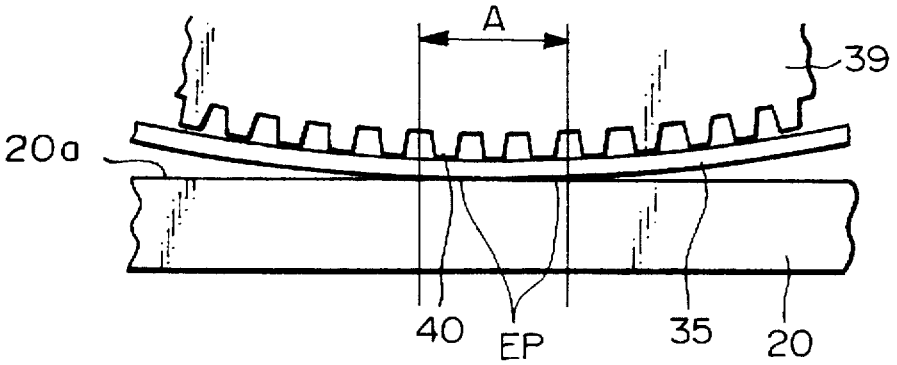
FIG. 6 is a sectional enlarged front view showing a portion of the cleaning device of FIG. 4 for removing contamination from a surface to be cleaned.
Figure 7:
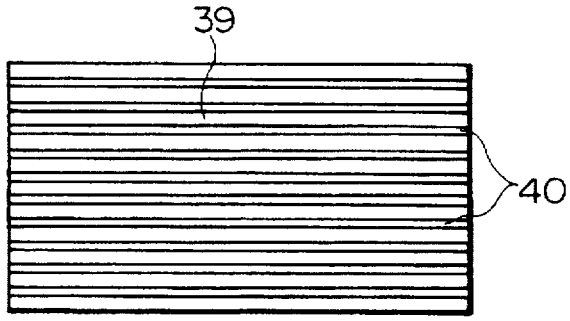
FIG. 7 shows a specific pattern formed on the surface of a presser member.

A cleaning device 31 is located in the vicinity of the discharger 22 for cleaning the conveying surface 20*a* of the belt 20. As shown in FIG. 5 in detail, the cleaning device 31 has a casing 32 accommodating a supply shaft 33 and a take-up shaft 34. While the supply shaft 33 is freely rotatable, the take-up shaft 34 is rotated by a drive section, not shown. A supply roller 36 on which a webbing 35 is wound is removably mounted on the supply shaft 33. A take-up roller 37 for taking up the webbing 35 is removably mounted on the take-up shaft 34. The shafts 33 and 34 and rollers 36 and 37 constitute a take-up mechanism in combination. A press roller 39 is mounted on the casing 32 and constantly biased by a spring 38 against a belt drive roller 18 with the intermediary of the belt 20 and webbing 35. The press roller 39 is a metallic roller whose surface is knurled. FIG. 7 shows a specific pattern formed on the press roller 39 by knurling and including a number of ridges 40. The ridges 40 each extends in the direction perpendicular to the direction in which the belt 20 conveys the sheet 12. As shown in FIG. 6, the press roller 39 presses the webbing 35 against the surface 20*a*of the belt 20 over a range A. A plurality of ridges 40 (three in embodiment) are constantly present in the above range A in the direction of movement of the belt 20.

A sensor 41 is responsive to the remaining amount of the webbing 35 wound round the supply roller 36. A back-tension mechanism, not shown, applies back-tension to the supply roller 36. A bare clutch or similar regulating mechanism, not shown, is also provided for preventing the press roller 39 from rotating in the direction in which it conveys the webbing 35 in the reverse direction.

The laser printer includes a microcomputer or control means mainly consisting of a CPU (Central Processing Unit) and memories, although not shown specifically. The microcomputer or control section controls the various sections of the laser printer with a conventional configuration and conventional basic processing.

In operation, the pick-up roller 16 and a separator roller 17 feed the uppermost sheet 12 from the sheet feed section 13 while separating it from the underlying sheets 12. Then, the electrophotographic process sections 24 start their operation for forming an image. Specifically, in each process section 24, a toner image is formed on the drum 25 by discharge, exposure and development effected by the main charger 26, optics 27 and developing unit 28, respectively. The image transfer unit 29 transfers, by reverse charging, the toner image to the sheet 12 electrostatically retained on the belt 20. As a result, yellow, magenta, cyan and black toner images are sequentially transferred to the sheet 12 one above the other to complete a color image. The color image on the sheet 12 is fixed by the fixing unit 23. Finally, the sheet 12 with the color image, i.e., a color copy is driven out to the discharge section 14.

During the image forming operation, there cannot be avoided the deposition of the developer and impurities including paper dust on the belt 20. Particularly, in the laser printer 11 using a liquid developer, the developer and impurities are apt to firmly adhere to the surface 20*a* of the belt 20 due to viscosity particular to the liquid developer. However, because the surface 20*a* of the belt 20 moves relative to the cleaning device 31 due to the rotation of the belt 20, the stain or deposits on the surface 20*a* can be successfully wiped off by the webbing 35 and collected thereby.

When the webbing 35 wipes off the stain, the edge-like portions EP stated earlier peel off even the developer or similar viscous substance deposited on the surface 20*a*. Further, a plurality of ridges 40 are present in the range A, FIG. 6, as stated previously. This further enhances the cleaning ability of the cleaning device.

The knurled metallic roller 39 has high rigidity due to the ridges 40 and surely forms the edge-like portions EP in the webbing 35 even when the webbing 35 is relatively thick. This allows the use of a relatively thick webbing for wiping off deposits firmly adhered to the surface 20*a*. Knurling is a conventional easy technology and therefore does not complicate the production of the press roller 36. Moreover, because knurling is capable of forming the ridges 40 accurately, the ridges 40 contact the surface 20*a* uniformly and further promote sure cleaning.

The mechanism for preventing the press roller 39 from conveying the webbing 35 in the reverse direction can be implemented by, e.g., a simple bare clutch built in one of opposite bearings, not shown, of the press roller 39. Such a mechanism prevents deposits once wiped off from being returned to the surface 20*a* of the belt 20.

Figure 8:
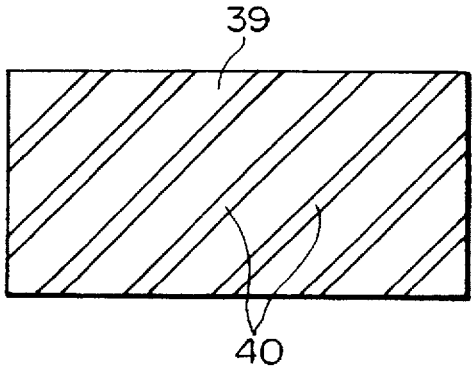
FIGS. 8–10 shows another specific pattern formed on the presser member.
Figure 9:
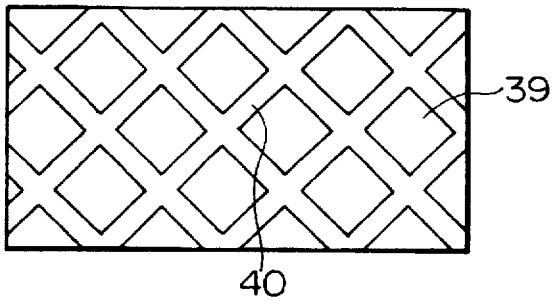
Figure 10:
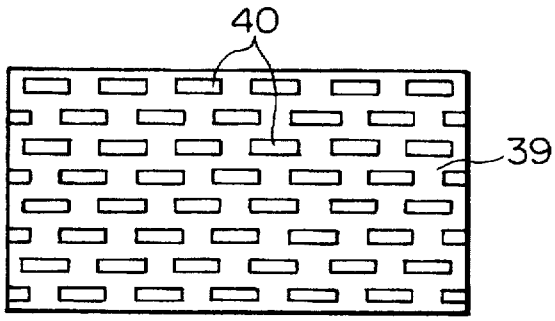

FIGS. 8–10 each shows a modification of the pattern including the ridges 40 and formed on the press roller 39. FIG. 8 shows a spiral pattern while FIG. 9 shows a double-hatch pattern. FIG. 10 shows a zigzag pattern. The alternative patterns shown in FIGS. 8–10 can be implemented with ease if the press roller 39 is formed of resin, rubber or similar material other than metal.

3rd Embodiment

Figure 11:
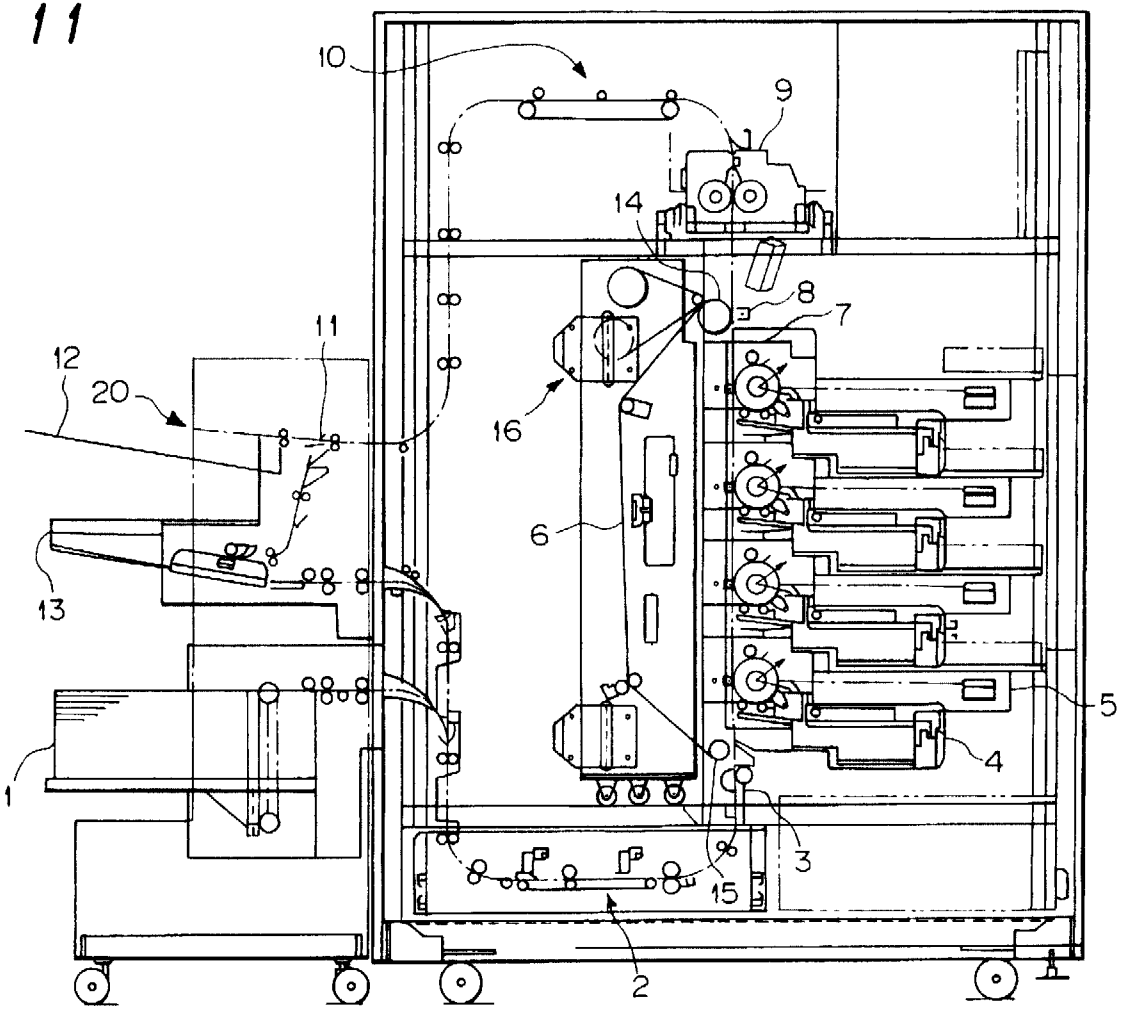
FIG. 11 shows the general construction of a copier representative of a third embodiment of the present invention.

This embodiment is applied to an electrophotographic copier belonging to a family of image forming apparatuses. As shown in FIG. 11, the copier includes a conveyor belt 6 passed over a drive roller 14 and a driven roller 15. While the driven roller 15 is freely rotatable, the drive roller 14 is driven by drive means, not shown. A sheet or recording medium, not shown, is electrostatically retained on the belt 6 and conveyed thereby. Process units 4 are sequentially arranged along the belt 6 in order to sequentially form yellow, magenta, cyan and black toner images, as in the second embodiment.

The sheet is fed from a sheet feed unit 1 to a horizontal registration unit 2 to have its horizontal position adjusted. Then, the sheet is conveyed to a leading edge registration sensor 3. As soon as the sheet moves away from the sensor 3, an optical writing unit 5 starts writing image data while each process unit 4 starts forming an image. The sheet electrostatically retained on the belt 6 is sequentially conveyed by way of the consecutive process units 4. At this instant, transfer rollers 7 included in the process units 4 sequentially transfer toner images to the sheet, forming a color image on the sheet. The sheet with the color image is separated from the belt 6 by a separation charger 8 and then fed to a fixing unit 9. The fixing unit 9 fixes the color image on the sheet with pressure and heat. Finally, the sheet is driven out to discharging unit 20. When a guide plate 11 included in the discharging unit 20 is oriented toward a tray 12, the color copy is driven out to the tray 12. When the guide plate 11 is oriented toward a duplex copy unit 13, the sheet is stacked on the duplex copy unit 13. The sheets sequentially stacked on the duplex copy unit 13 will be again fed to the process units later.

Figure 12:
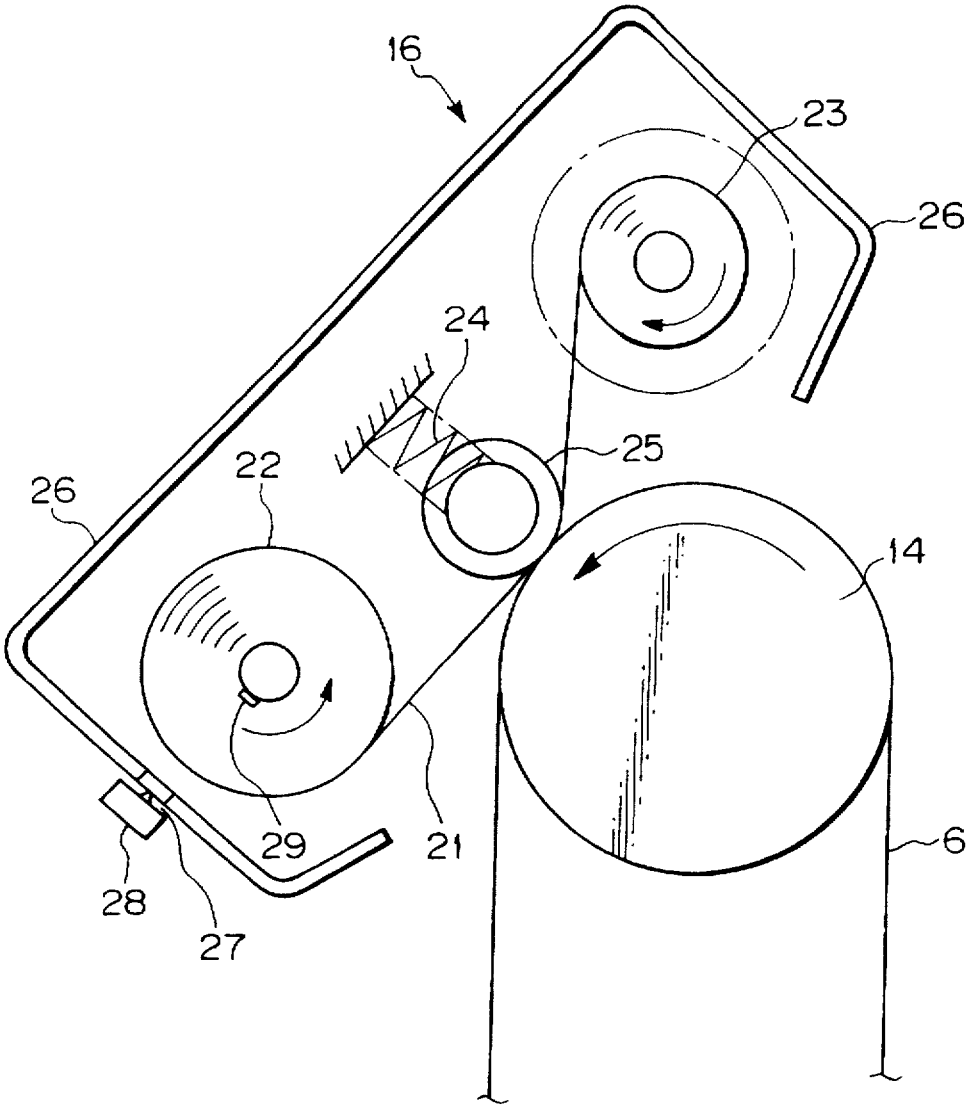
FIG. 12 is a section of a cleaning device applied to the copier shown in FIG. 11.

A cleaning device 16 is positioned at the left-hand side of the drive roller 14 for removing deposits including the liquid developer and impurities from the surface of the belt 6. As shown in FIG. 12, the cleaning device 16 uses a webbing 21 in the form of a roll and implemented by unwoven cloth, tissue paper or similar fibrous material. The webbing 21 is paid out from a supply roller 22 and taken up by a take-up roller 23. A spring 24 constantly biases a press roller or pressing member 25 against the webbing 21 between the supply roller 22 and the take-up roller 23. Therefore, the press roller 25 constantly presses the above part of the webbing 21 against the drive roller 14. While the belt 6 runs with the drive roller 14 pressed against the drive roller 14, the webbing 21 wipes off the liquid developer remaining on the conveying surface of the belt 6 and collects it.

A stepping motor, not shown, drives the take-up roller 23 at a predetermining timing. Every time the take-up roller 23 is rotated, the webbing 21 is paid out from the supply roller 22 little by little. As a result, the webbing 21 cleans the belt 6 with a new wiping surface at all times. The supply roller 22, take-up roller 23 and press roller 25 are accommodated in a casing 26. A window 27 is formed in the casing 26 in the vicinity of the supply roller 22. An end sensor 28 is positioned outside of the casing 26 in alignment with the window 27. When the end sensor 28 senses an end mark 29 provided on the end of the webbing 21, the fact that cleaning device has run out of the webbing 21 is displayed on an operation and display panel, not shown, included in the copier. This urges the operator to replenish the webbing 21.

The cleaning device 16 having the above configuration operates under the control of a controller, not shown, as follows. During usual image forming operation, the stepping motor causes the take-up roller 23 to rotate at a preselected timing while taking up the webbing 21. How much the webbing 21 should be paid out depends on the kind of an image to be reproduced, the toner absorbing ability of the webbing 21, and so forth. Usually, the webbing 21 should preferably be paid out by 2 percent of the length of an image. A greater amount of pay-out would enhance the cleaning ability and improve image quality, but would aggravate the consumption of the webbing 21. A smaller amount of pay-out would save the webbing 21, but would lower image quality. As to the timing, the webbing 21 may be paid out once for every copying cycle or for a plurality of consecutive copying cycles in order to said webbing 21. While the embodiment pays out the webbing 21 once for a plurality of copying cycles, it varies the cleaning operation in accordance with the varying operating condition of the copier, as will be described later specifically.

While the copier writes a preselected control image for a control purpose, the cleaning device 16 performs the following operation. Specifically, for the replenishment of toner and process control, the copier writes a preselected control image on the photoconductive drum once for a plurality of consecutive image forming cycles. A potential sensor or an image sensor reads the control image and feeds back its output to a controller or control means implemented by, e.g., a CPU, not shown. While usually no images exist between images (sheets), the control image is written in this case. Therefore, the toner transferred to the belt 6 deposits on the wiping surface of the webbing 21. If the toner accumulates between the webbing 21 and the belt 6, another toner deposited on the belt 6 is apt to pass through the cleaning position. In light of this, after the control image has moved away from the webbing 21, the cleaning device 16 pays out the webbing 21 by a preselected amount in order to replace the wiping surface to be pressed against the drive roller 14.

Figure 13:
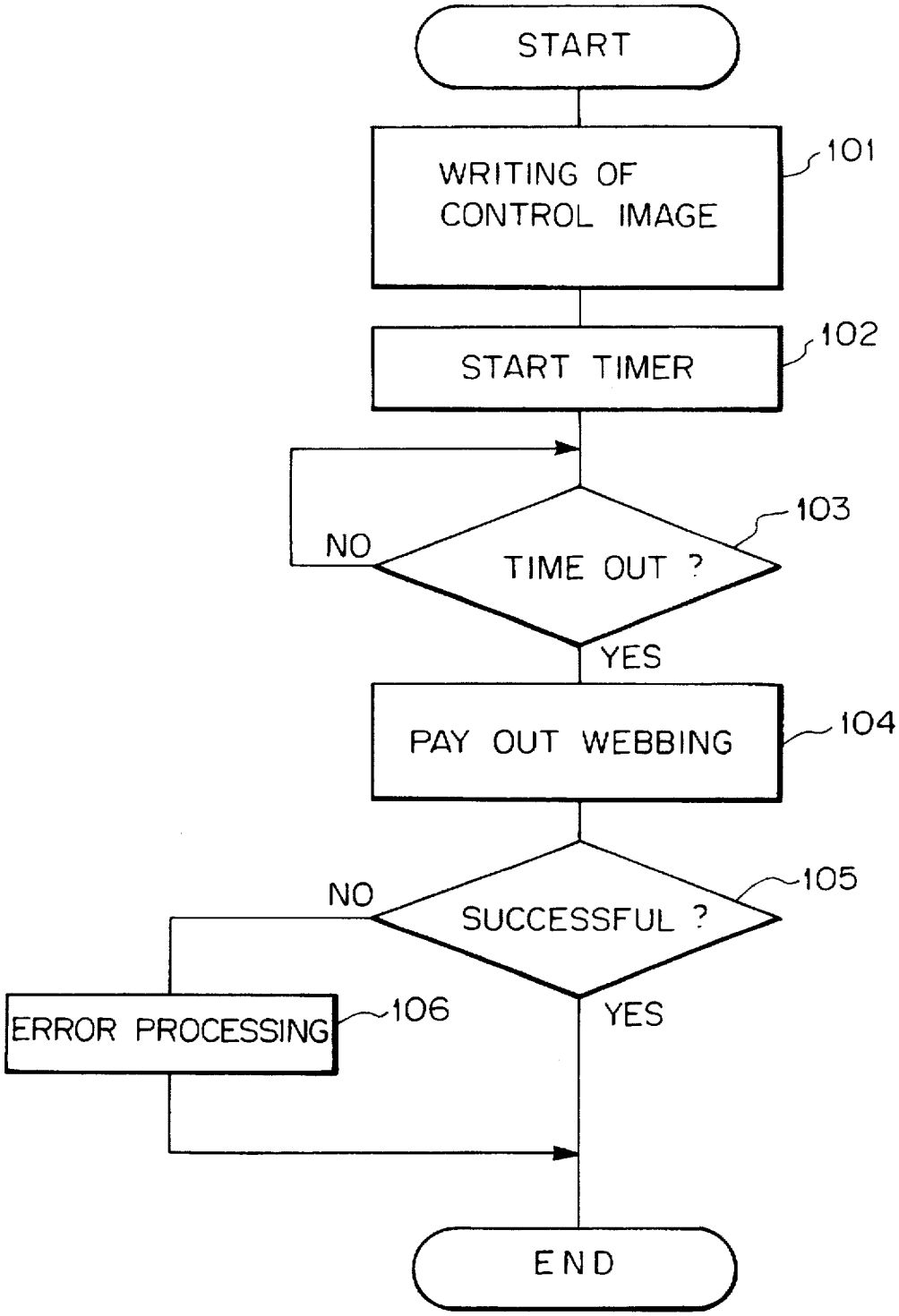
FIG. 13 is a flowchart demonstrating a specific cleaning procedure particular to the third embodiment and executed when a control image is written.

FIG. 13 is a flowchart demonstrating the above procedure associated with the control image. As shown, when the control image is written (step 101), the controller starts a timer, not shown, (step 102). At this time, a cleaning operation begins. When the time of the timer expires (YES, step 103), the controller determines that the control image has moved away from the wiping surface of the webbing 21, and pays out the webbing 21 (step 104). Then, the controller determines whether or not the webbing 21 has been successfully paid out (step 105). If the answer of the step 105 is positive (YES), the controller ends the routine. If the answer of the step 105 is negative (NO), the controller displays an error on the operation and display panel (step 106), and then ends the routine.

After the webbing 21 has been used in a condition most likely to cause the toner to deposit on the belt 6, the wiping surface is constantly replaced by the routine described above. This maintains the surface of the belt 6 in a desirable condition. It follows that the belt 6 can be used for the next image formation only if it passes through the wiping position once.

The timing for writing the control image is managed by the controller which controls the sequence of the copier. The interval between the time when the control image is formed on the drum and the time when the toner transferred to the belt 6 arrives at the wiping surface of the webbing 21 can be computer on the basis of the length of the path and the linear velocity (sheet conveying speed). Therefore, if the period of time necessary for the control image to reach the wiping surface of the webbing 21 is set in a timer, the wiping surface can be replaced at the time when the image has fully moved away from the wiping surface.

Assume that the copier has its image forming operation interrupted due to a jam, door opening or similar error. Then, it is likely that the surface of the photoconductive drum has been unusually wetted due to the emergency stop and has, in turn, wetted the belt 6 to an unusual degree. In this condition, should the webbing 21 be paid out in the usual amount, it would absorb an unexpected amount of liquid itself and would fail to remove the liquid from the belt 6. In the illustrative embodiment, the cleaning device 16 pays out the webbing 21 more than usual at the time of recovery from the above error. Specifically, the webbing 21 is paid out in an amount several percent greater than the usual amount (about 2 percent of the image length) or in an amount determined by experiments.

Figure 14:
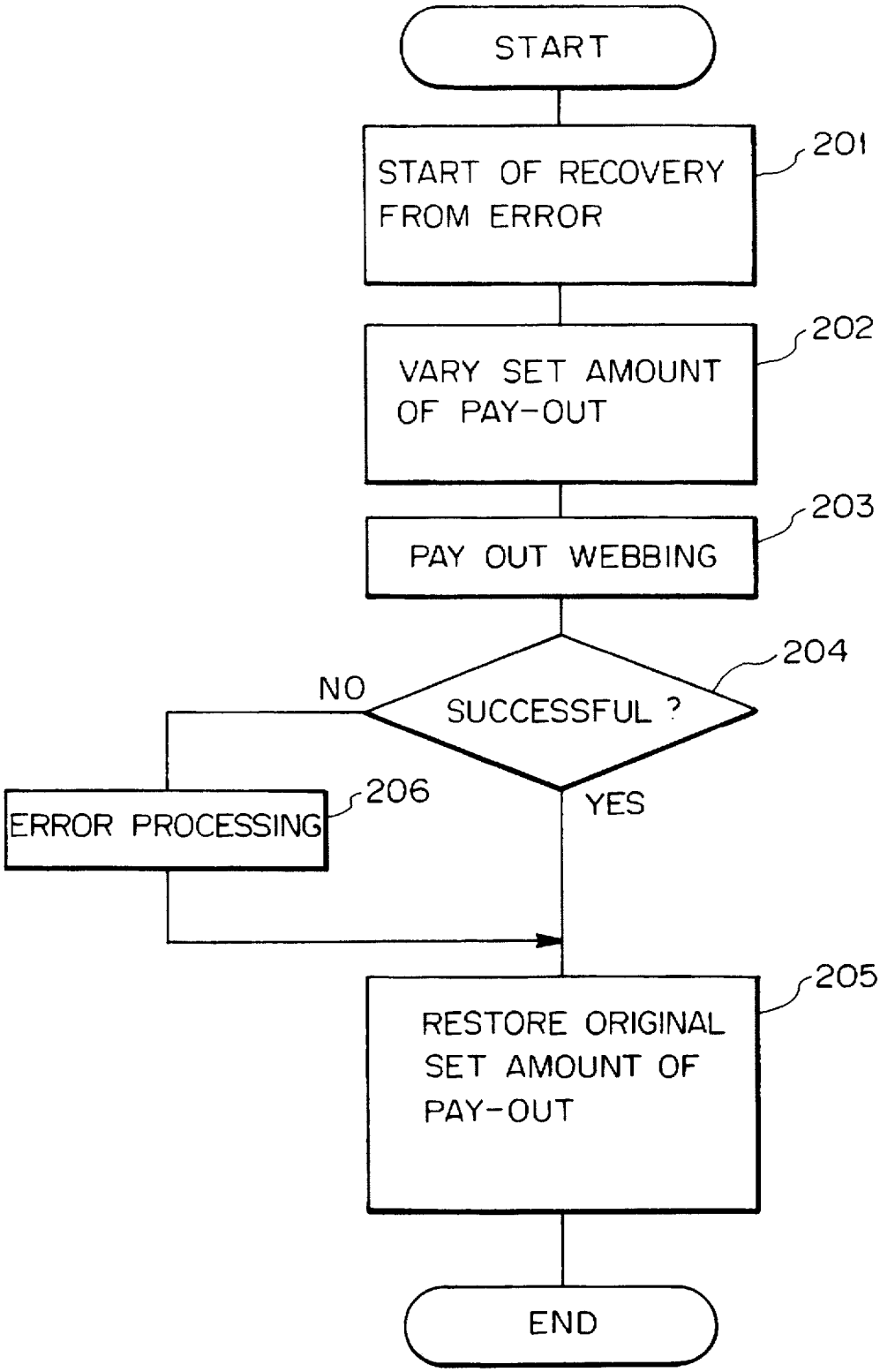
FIG. 14 is a flowchart showing a specific cleaning routine to be executed at the time of recovery from an error.

FIG. 14 shows a routine to be executed by the controller at the time of recovery from the error. On starting a recovery procedure (step 201), the controller varies the set amount of pay-out of the webbing 21, i.e., makes it greater than the usual amount by a preselected amount (step 202). Next, the controller pays out the webbing 21 (step 203) and then determines whether or not the pay-out has been successful (step 204). If the answer of the step 204 is YES, the controller restores the amount of pay-out to the usual amount (step 205) and ends the routine. If the answer of the step 204 is NO, the controller displays an error on the operation and display panel (step 206) and then ends the routine by way of the step 205.

As stated above, the webbing 21 is paid out more than usual when the liquid developer is deposited on the belt 6 in a great amount. Therefore, the webbing 21 can sufficiently absorb the excess liquid. It follows that a dry portion of the webbing 21 appears at the wiping position without fail and maintains the belt 6 in a desirable condition without regard to the degree of wetting of the belt 6.

When a power switch, not shown, provided on the copier is turned on, the cleaning device 16 operates, as follows. Generally, during the interval between the turn-off of the power switch and the subsequent turn-on of the same, it is likely that the toner deposited on the belt 6 has dried. The toner dried and firmly adhered to the belt 6 cannot be fully removed if the belt 6 is passed through the wiping or cleaning position only once.

To solve the above problem, this embodiment increases, at the initial stage of operation following the power-up, the duration of contact of the webbing 21 with the surface of the belt 6. The period of time necessary for the belt 6 to make one turn between the rollers can be computed on the basis of the length of the path and the linear velocity (sheet conveying speed). In addition, experiments showed that the toner dried and firmly adhered to the belt 6 can be removed if the belt 6 is cleaned about ten consecutive items (ten turns). The cleaning device 16 therefore cleans the belt 6 ten or more consecutive times at the time of the start-up of the copier. At the time of the start-up, the controller starts a timer in which a period of time necessary for the cleaning to be repeated ten or more consecutive times has been set beforehand. The controller causes the cleaning to be repeated until the time of the timer expires. Alternatively, a particular mark may be provided on any preselected portion of the belt 6 and sensed by a sensor. In such a case, the cleaning will be repeated until the number of outputs of the sensor coincides with a preset number of items of cleaning, e.g., fifteen times.

Figure 15:
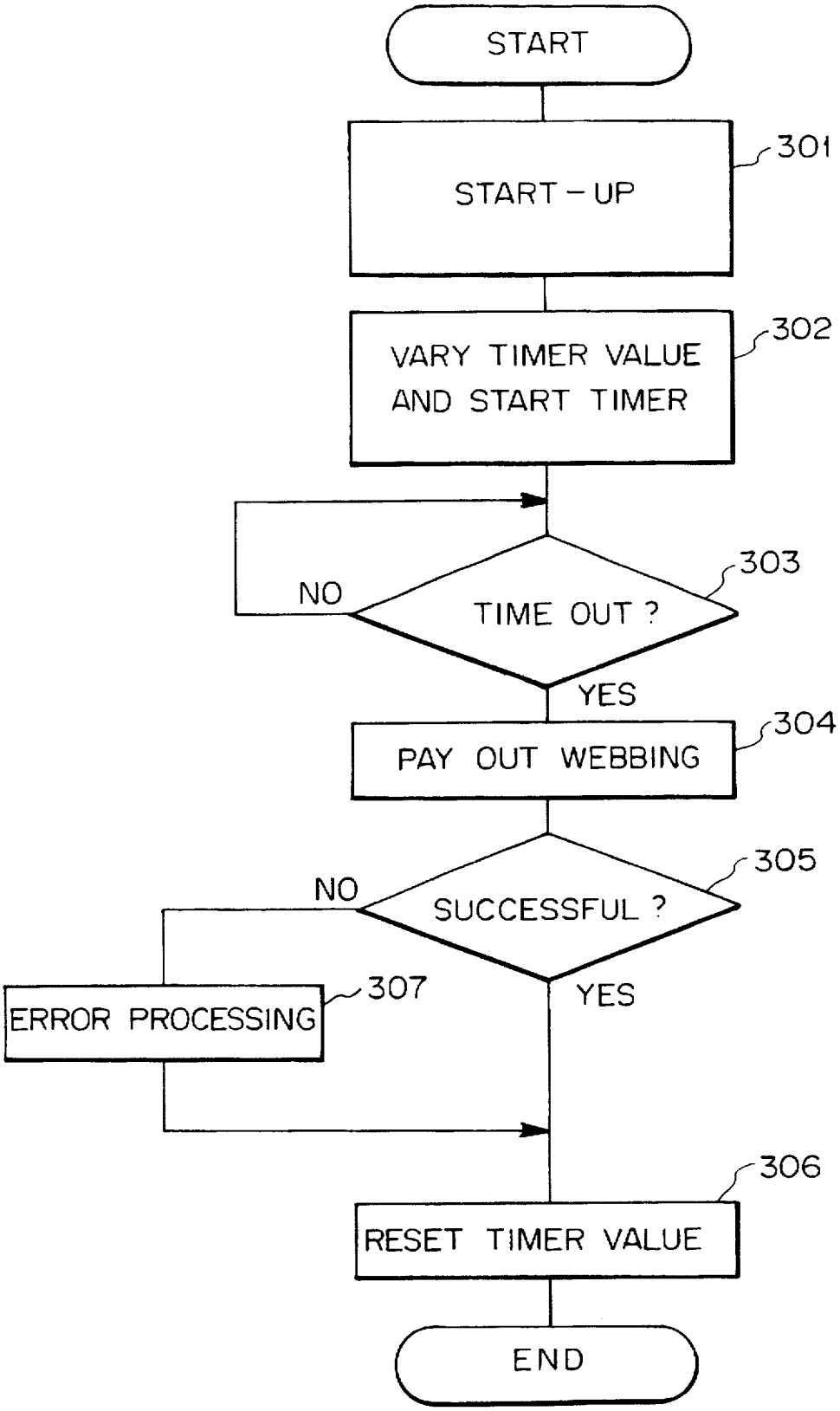
FIG. 15 is a flowchart showing a specific cleaning routine to be executed at the initial stage of operation following power-up.

Specifically, as shown in FIG. 15, on starting the start-up operation following the turn-on of the power switch (step 301), the controller sets a period of time longer than usual one in a timer, not shown, and then starts the timer (step 302). At the same time, the cleaning device 16 starts its cleaning operation. When the time of the timer expires (YES, step 303), the controller pays out the webbing 21 (step 304) and then determines whether or not the pay-out has been successful (step 305). If the answer of the step 305 is YES, the controller resets the timer (step 306) and then ends the routine. If the answer of the step 305 is NO, the controller displays an error on the operation and display panel (step 307) and then ends the routine.

As stated above, when the toner on the belt 6 is dry, the embodiment increases the period of time during which the webbing 21 contacts the belt 6 and thereby fully removes the toner adhered to the belt 6.

As described above, the illustrative embodiment controls the cleaning operation in accordance with the operating condition of the copier, e.g., whether it writes the control image, whether it is recovered from an error, or whether it is started up. Therefore, even when the degree or the kind of contamination of the belt 6 is irregular due to the varying operation condition of the copier, the toner and impurities deposited on the belt 6 can be removed in the optimal manner.

4th Embodiment

Figure 16:
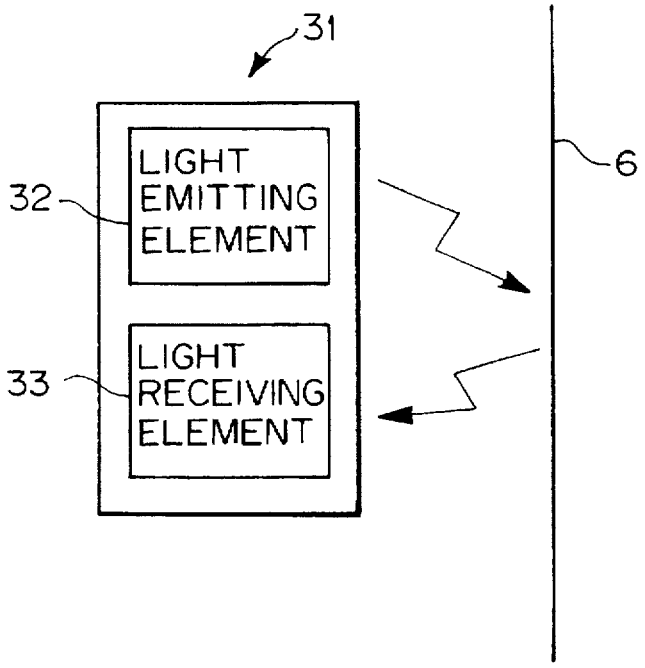
FIG. 16 shows an optical sensor included in a fourth embodiment and playing the role of contamination sensing means.

In this embodiment, the copier has contamination sensing means responsive to the degree of contamination of the belt 6 in addition to the various units of the third embodiment. FIG. 16 shows the general configuration of an optical sensor serving as the contamination sensing means. As shown, the optical sensor is a reflection type sensor made up of a light emitting element 32 and a light receiving element 33. While the light emitting element 32 emits light, the light is reflected by the surface of the belt 6 and then incident to the light receiving element 33. The two elements 32 and 33 are located in the same plane. The belt 6 is formed of PET (polyethylene terepthalate) or similar glossy material. If desired, the two elements 32 and 33 may be respectively positioned at the inside and the outside of the belt 6 such that light issuing from the element 32 is transmitted through the belt 6 and incident to the element 33 (transmission type sensor). In FIG. 12, the optical sensor 31 is positioned downstream of the cleaning device 16 in the direction of conveyance of the belt 6.

Figure 17:
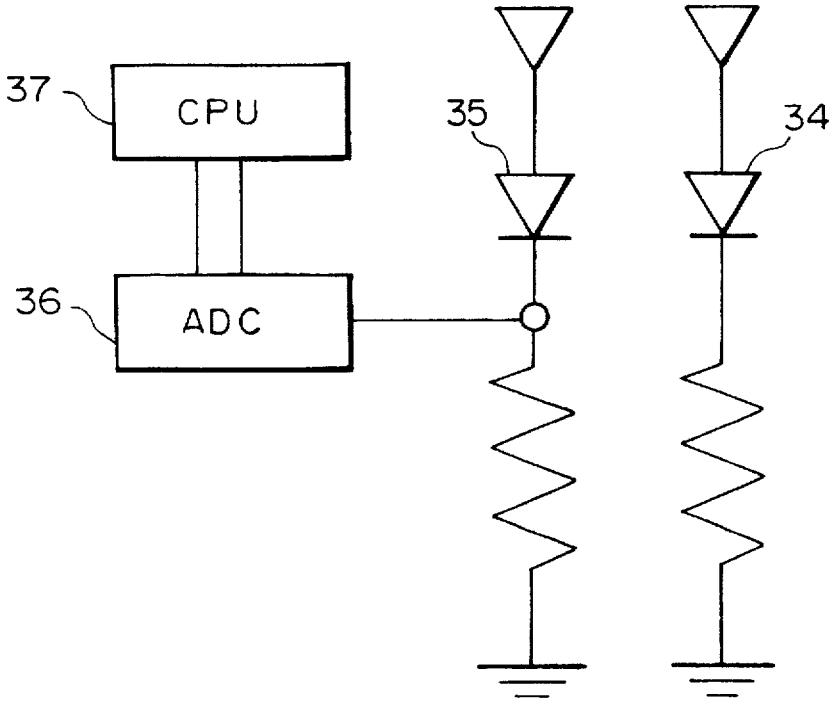
FIG. 17 shows a circuit including the optical sensor.

FIG. 17 shows a circuit arrangement including the optical sensor 31. As shown, an LED (Light Emitting Diode) 34 and a photodiode (or phototransistor) 35 are used as the light emitting element 32 and light receiving element 33, respectively. The output of the photodiode 35 is connected to a CPU 37 included in the controller via an analog-to-digital converter (ADC) 36.

In the circuitry shown in FIG. 17, when the LED 34 emits light toward the belt 6, the resulting reflection from the belt 6 is incident to the photodiode 35. The photodiode 35 transforms the incident light to a corresponding electric signal. The electric signal is digitized by the ADC 36 and then input to the CPU 37. In response, the CPU 37 determines the degree of contamination of the belt 6. Specifically, if the degree of contamination of the belt 6 is high, the amount of reflection from the belt 6 and therefore the signal value input to the belt 6 decreases. It follows that if a value representative of the clean state or the allowable contamination of the belt 6 is set in the CPU 37 beforehand, the CPU 37 can determine the degree of contamination by comparing the input signal value with the set value.

In the third embodiment, the cleaning operation is repeated more than ten consecutive times in the initial or start-up stage following power-up. However, such a frequency of cleaning is sometimes excessive or sometimes short, depending on the degree of contamination of the belt 6. Therefore, when the contamination is removed by a smaller number of times, the rest of the cleaning operation is wasteful. Conversely, when the contamination cannot be removed by the preselected number of times of cleaning, image formation will begin with the contaminated belt 6.

In light of the above, at the start-up stage following power-up, the optical sensor 31 emits light toward the surface of the belt 6 while a signal value representative of the resulting reflection is input to the CPU 37. In response, the CPU 37 determines the degree of contamination of the belt 6. Subsequently, the CPU 37 causes the cleaning to be repeated until no contamination has been sensed during one turn of the belt 6, i.e., until the signal value input the CPU 37 decreases below a preselected value. If the condition that the contamination cannot be removed despite the repeated cleaning continues for more than a preselected period of time, the CPU 37 displays an error message on the operation and display panel so as to alert the operator to such an error.

By the above control to be executed at the time of start-up, the cleaning operation is repeated an adequate number of times matching the actual degree of contamination of the belt 6. Therefore, when contamination is fully removed by a smaller number of times of cleaning, the rest of the cleaning operation is saved and allows image formation to begin immediately. Even when contamination cannot be removed by a preselected number of items of cleaning, the cleaning continues until the contamination has been fully removed. This successfully prevents image formation from beginning with the contaminated belt 6.

During usual image formation, the cleaning device 16 operates as follows. Again, the light issuing from the optical sensor 31 is reflected by the conveying surface of the belt 6 and then transformed to a signal value. The signal value is input the CPU 37. If the signal value exceeds the preselected value, the CPU 37 determines that the belt 6 has been contaminated due to some error, and then interrupts image formation under way. Subsequently, the CPU 37 causes cleaning to be executed (rotation of the belt 6 and pay-out of the webbing 21), thereby removing the contamination. As soon as the signal value input to the CPU 37 coincides with or falls below the preselected value, the CPU 37 causes the cleaning to end and resumes the image formation. Again, if the condition that the contamination cannot be removed despite the repeated cleaning continues for more than a preselected period of time, the CPU 37 displays an error message on the operation and display panel so as to alert the operator to such an error.

With the above control executed during usual image formation, it is possible to clean the belt 6 immediately when the belt 6 is contaminated due to some error. Therefore, image formation can be desirably effected without smearing sheets despite any unexpected contamination of the belt 6.

5th Embodiment

Figure 18:
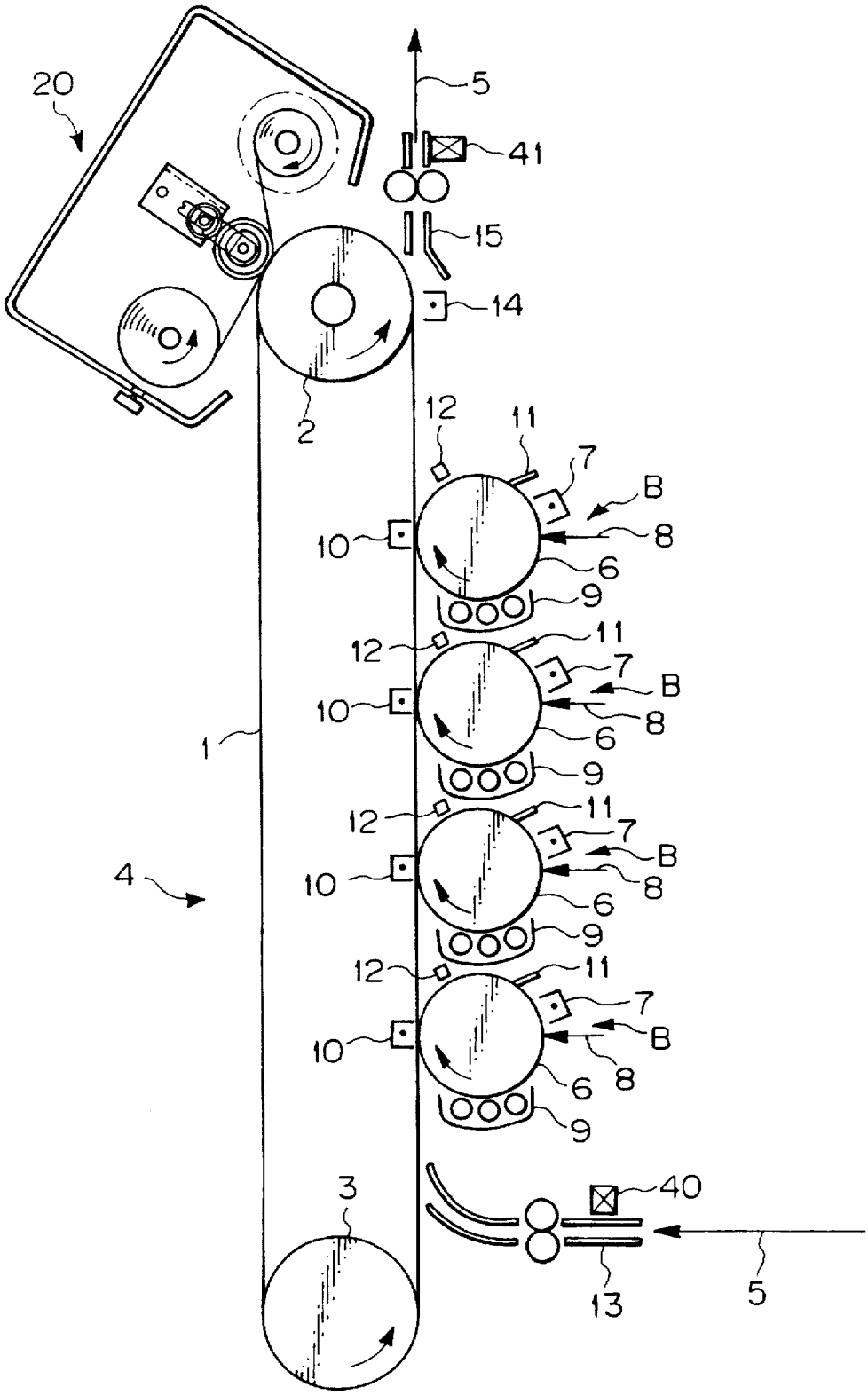
FIG. 18 is a front view showing a fifth embodiment of the present invention.

Referring to FIG. 18, a fifth embodiment of the present invention is shown and implemented as a copier. As shown, the copier includes a conveying unit 4 having a conveyor belt 1, a drive roller 2, a driven roller 3, and so forth. A yellow, a magenta, a cyan and a black toner image forming unit Y, M, C and B sequentially form toner images on a sheet 5 being conveyed by the belt 1.

Because the toner image forming units Y–B are identical in configuration, let the following description concentrate on the toner image forming unit Y by way of example. The image forming unit Y includes a photoconductive element or image carrier 6. Arranged around the drum 6 are a main charger 7, optics 8 for exposure, a developing unit 9, an image transfer unit 10, a drum cleaning unit 11, and a discharger 12. The developing unit 9 stores a liquid developer, i.e., toner dispersed in carrier. Therefore, the developing unit 9 is located below the drum 6 in order to prevent the liquid developer from dropping and disfiguring the toner image formed on the drum 6. This is why the image transfer unit 10 is located at the side of the drum 6, the drum cleaning unit 11 is located above the drum 6, and the toner image forming units Y–B are arranged one above the other. The belt 1 conveys the sheet 5 in the vertical direction along the toner image forming units Y–B. A first guide plate 13 is positioned upstream of the toner image forming unit Y with respect to the direction of rotation of the belt 1. The sheet 5 is fed from a sheet feed unit, not shown, to the belt 1 along the guide plate 13.

The belt 1 is passed over a drive roller 2 and a driven roller 3. The drive roller 2 is driven by a drive mechanism, not shown. The belt 1 is movable at the same speed as the drums 6 of the toner image forming units Y–B. While the sheet 5 fed via the guide plate 13 is conveyed by the belt 1 from the bottom toward the top, the toner image forming units Y–B sequentially transfer yellow, magenta, cyan and black toner images to the sheet 5 one above the other to complete a color image. The sheet 5 with the color image is separated from the belt 1 by a discharger 14 and then fed to a fixing unit, not shown. After the toner image has been fixed on the sheet 5 by the fixing unit, the sheet 5 is driven out of the copier.

The copier with the above construction can form images on the drums 6 color by color and therefore outputs a single image in a shorter period of time than a copier repeatedly forming images on a single drum. A color copier PRETER (trade name) available from Ricoh (Japan) includes a plurality of drums and a single conveyor belt. However, PRETER uses a dry developer. An image forming apparatus using a liquid developer, a plurality of photoconductive drums and a single conveyor belt, as in the illustrative embodiment, has not been proposed in the imaging art.

Figure 19:
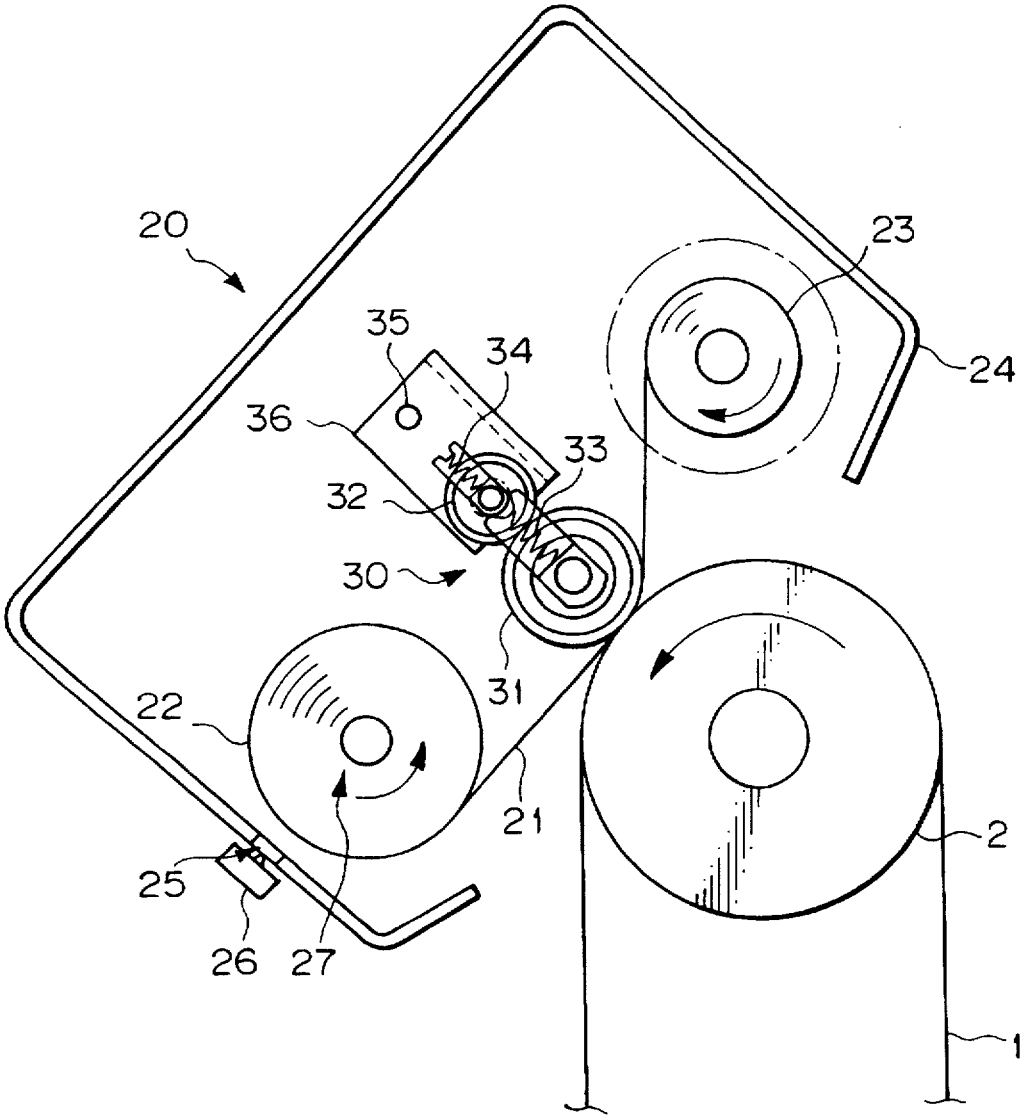
FIG. 19 is an enlarged front view of a cleaning device included in the fifth embodiment.

In the embodiment, a cleaning device 20 is positioned downstream of the separation charger 14 with respect to the direction in which the belt 1 moves. The cleaning device 20 removes the liquid developer deposited on the conveying surface of the belt 1. As shown in FIG. 19, the device 20 uses a webbing 21 of fibrous hygroscopic material, i.e., tissue paper and implemented as a roll. The webbing 21 is paid out from a supply roller 22 and taken up by a take-up roller 23. The take-up roller 23 takes up the webbing 21 by being driven by a stepping motor, not shown. A presser member 30 presses the webbing 21 between the supply roller 22 and the take-up roller 23 against the belt 1. The two rollers 22 and 23 and presser member 30 are mounted on a casing 24. A window 25 is formed in the casing 24 in the vicinity of the supply roller 22. An end sensor 26 is located outside of the casing 24 in alignment with the window 25, and senses an end mark 27 provided at the end of the webbing 21. When sensor 26 senses the end mark 27, a message for urging the operator to replenish the webbing 21 appears on an operation and display panel provided on the copier.

In the illustrative embodiments a mechanism is provided for varying the pressure of the presser member 30 acting on the belt 1, i.e., the webbing 21, as follows. As shown in FIG. 19, the presser member 30 is made up of a press roller 31, a pressure change roller 32, springs 33 and 34, and a bracket 36. The press roller 31 presses the webbing 21 against the belt 1, as stated earlier. The pressure change roller 32 is used to push up the press roller 31. The springs 33 and 34 are respectively affixed to the shaft portions of the rollers 31 and 32, and each constantly biases the associated roller 31 or 32. The bracket 36 supports the shaft of the roller 32 at one end thereof and is mounted on a rotary shaft 35 at the other end. The rotary shaft 35 is journalled to opposite side walls of the copier. In this configuration, the bracket 36 is rotatable about the shaft 35 between a position where the roller 32 contacts the roller 31 and a position where the former is spaced from the latter.

Figure 20:
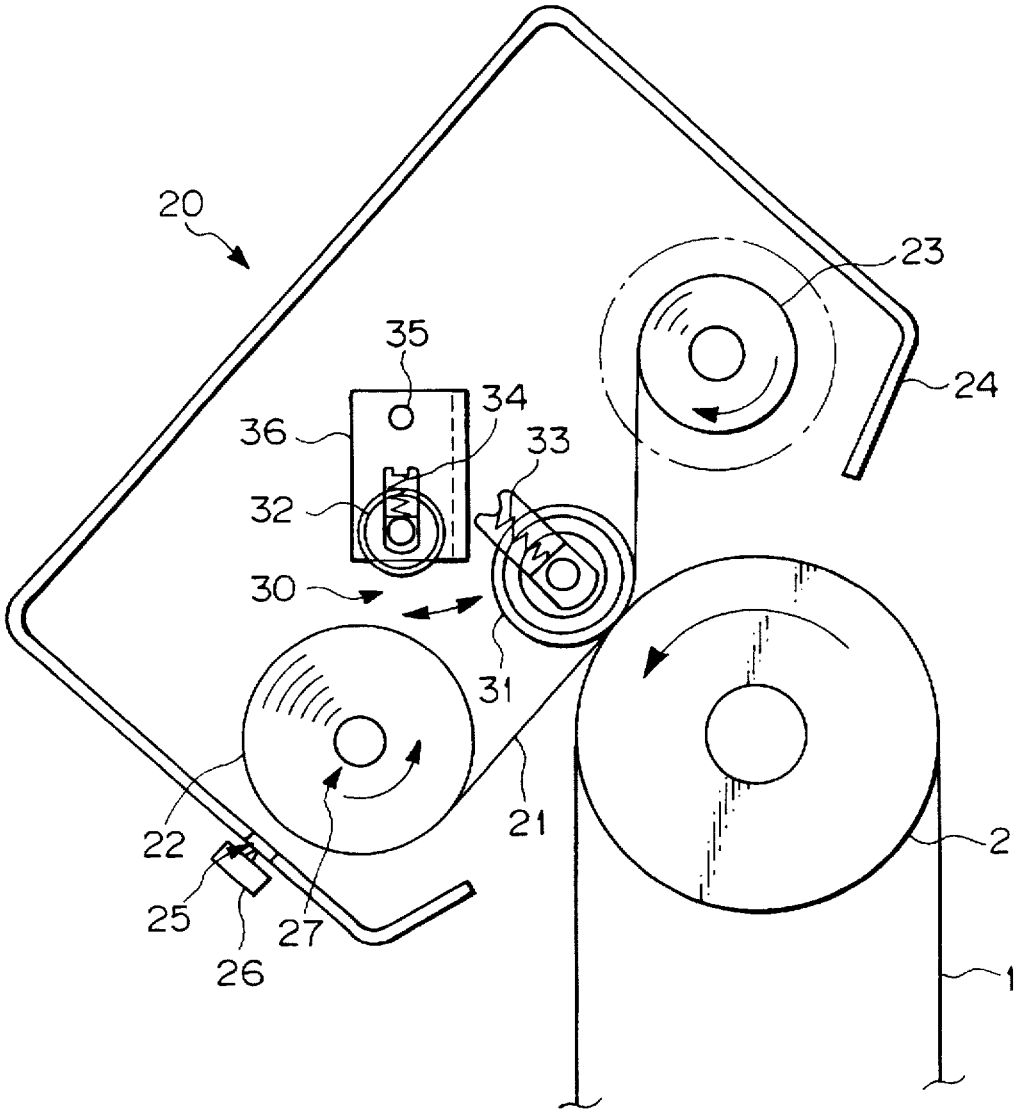
FIG. 20 shows the cleaning device of FIG. 19 in a condition wherein a pressure change roller is spaced form a press roller.

FIG. 19 shows the condition wherein the pressure change roller 32 is held in contact with the press roller 31. FIG. 20 shows the condition wherein the roller 32 is spaced from the roller 31. In the condition shown in FIG. 19, not only the bias of the spring 33 but also the bias of the spring 34 associated with the roller 32 act on the roller 31. As a result, the roller 31 presses the belt 1 with a greater force than when the roller 32 is spaced from the roller 31. The condition shown in FIG. 19 is maintained during usual image formation.

When the conveyance of the sheet 5 in the above copier is defective, the cleaning device 20 operates as follows. To detect errors in the conveyance of the sheet 5, a first sensor 40 and a second sensor 41 are located in the vicinity of the first guide plate 13 and a second guide plate 15, respectively. When the sensor 40 or 41 senses an error, control means, not shown, interrupts image formation while causing the belt 1 to rotate. On the other hand, the rotary shaft 35 of the cleaning device 20 is rotated by a gear operatively connected to a motor, not shown, with the result that the pressure change roller 32 is moved to the position of pushing up the press roller 31. In this condition, the control means causes the stepping motor to rotate. Consequently, the take-up roller 23 starts taking up the webbing 21 while the webbing 21 removes the liquid developer from the surface of the belt 1.

As stated above, during usual image formation, the take-up roller 23 is rotated by the stepping motor to take up the webbing 21. The webbing 21 removes the liquid developer from the surface of the belt 1. Because the webbing 21 absorbs the liquid developer, the liquid can be effectively removed from the surface of the belt 1. Because the liquid developer is not scraped off, but simply absorbed by the webbing 21, there is not needed a device for collecting toner scraped off by, e.g., a cleaning device using a roller. Moreover, because a fresh cleaning portion of the webbing 21 is frequently fed to the cleaning position, the embodiment prevents the cleaning ability from falling due to, e.g., the deterioration of a blade included in a cleaning device maintaining a rubber blade or similar blade in contact with a belt.

Generally, when the conveyance of the sheet 5 is defective, the liquid developer deposits on the belt 1 in a greater amount than during usual image formation. However, in the illustrative embodiment, in the event of defective conveyance, the webbing 21 is pressed against the belt 1 more strongly than during usual image formation in order to enhance the cleaning ability. Therefore, even when a great amount of liquid developer deposits on the belt 1, the embodiment is capable of fully cleaning the belt 1 and thereby freeing the rear of the next sheet 5 from projection while obviating defective image transfer.

6th Embodiment

In the fifth embodiment, assume that the liquid developer is deposited on the belt 1 in an unusually great amount. Then, it sometimes occurs that after the cleaning device 20 has removed the developer, the developer is again transferred from the webbing 21 to the belt 1 although in a small amount. The developer so returned to the belt 1 is more dry than the usual liquid developer because it has been absorbed by the webbing 21 once and has lost a part of its carrier. In light of this, auxiliary cleaning means may be positioned downstream of the device 20 in the direction of conveyance in order to clean the belt 1 again, as follows.

Figure 21:
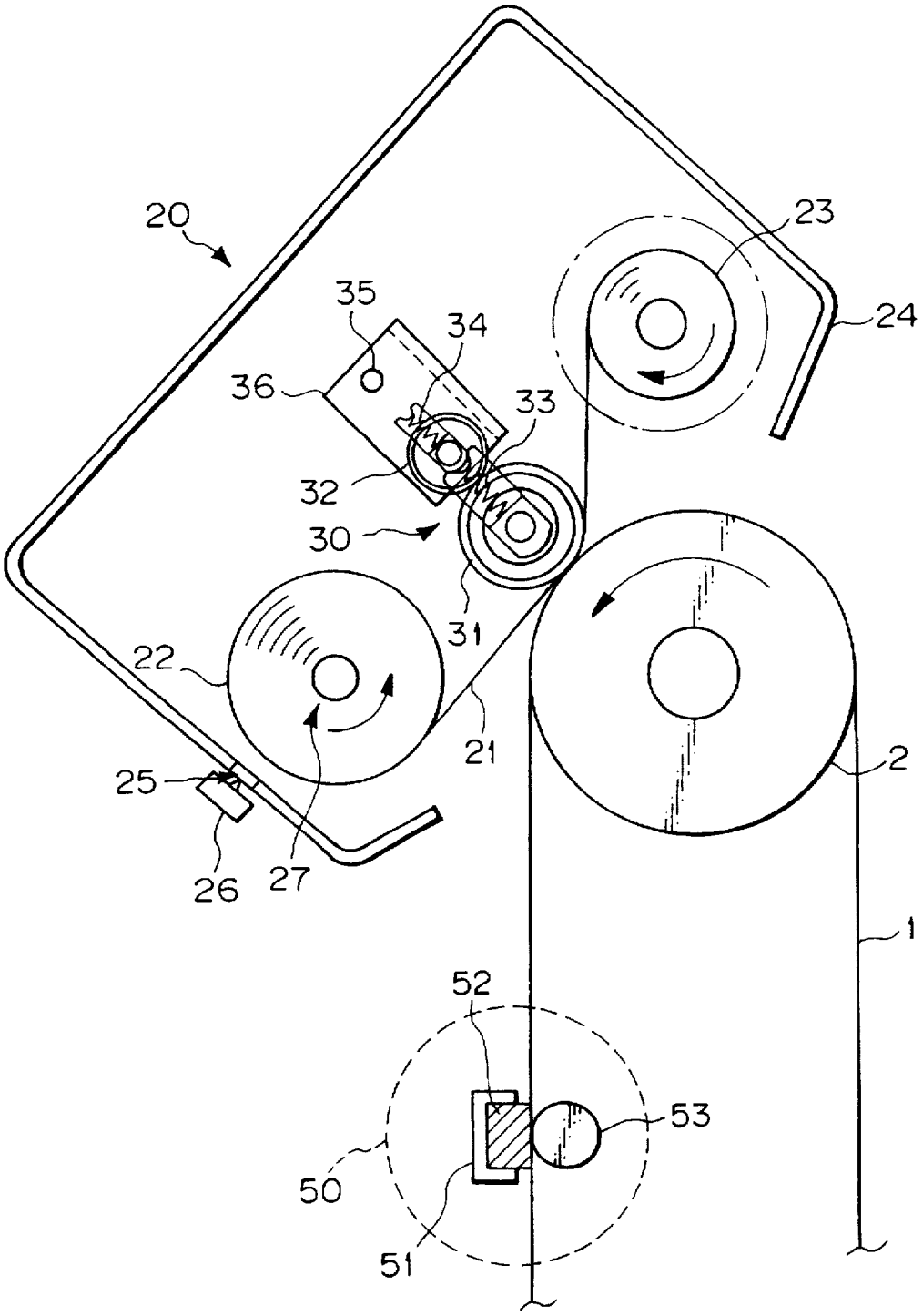
FIG. 21 is an enlarged front view showing a main and an auxiliary cleaning device representative of a sixth embodiment.

FIG. 21 shows a specific configuration of an auxiliary cleaning device representative of a sixth embodiment of the present invention. As shown, the auxiliary cleaning device, generally 50, has a piece of felt 52 held by a sheet metal 51 and contacting the surface of the belt 1 at its end, and a back-up roller 53 urging the belt 1 against the felt 52 under a desired pressure. The cleaning device 50 is positioned downstream of the cleaning device, or main cleaning device, 20 in the direction in which the belt 1 conveys the sheet. The felt 52 slightly rubs itself against the belt 1 and removes the developer returned from the webbing 21 to the belt 1 while the belt 1 is in movement. The combination of the main and auxiliary cleaning devices 20 and 50 further promotes the effective cleaning of the belt 1, compared to the case using the cleaning device 20 alone.

The developer again deposited on the belt 1 and lost a part of its carrier, as stated above, just lightly rest on the belt 1. Therefore, should such a developer be conveyed by the belt 1, it might fly about in the copier or might prevent the sheet 5 from being surely retained by the belt 1. The auxiliary cleaning device 50 obviates this kind of occurrence.

Figure 22:
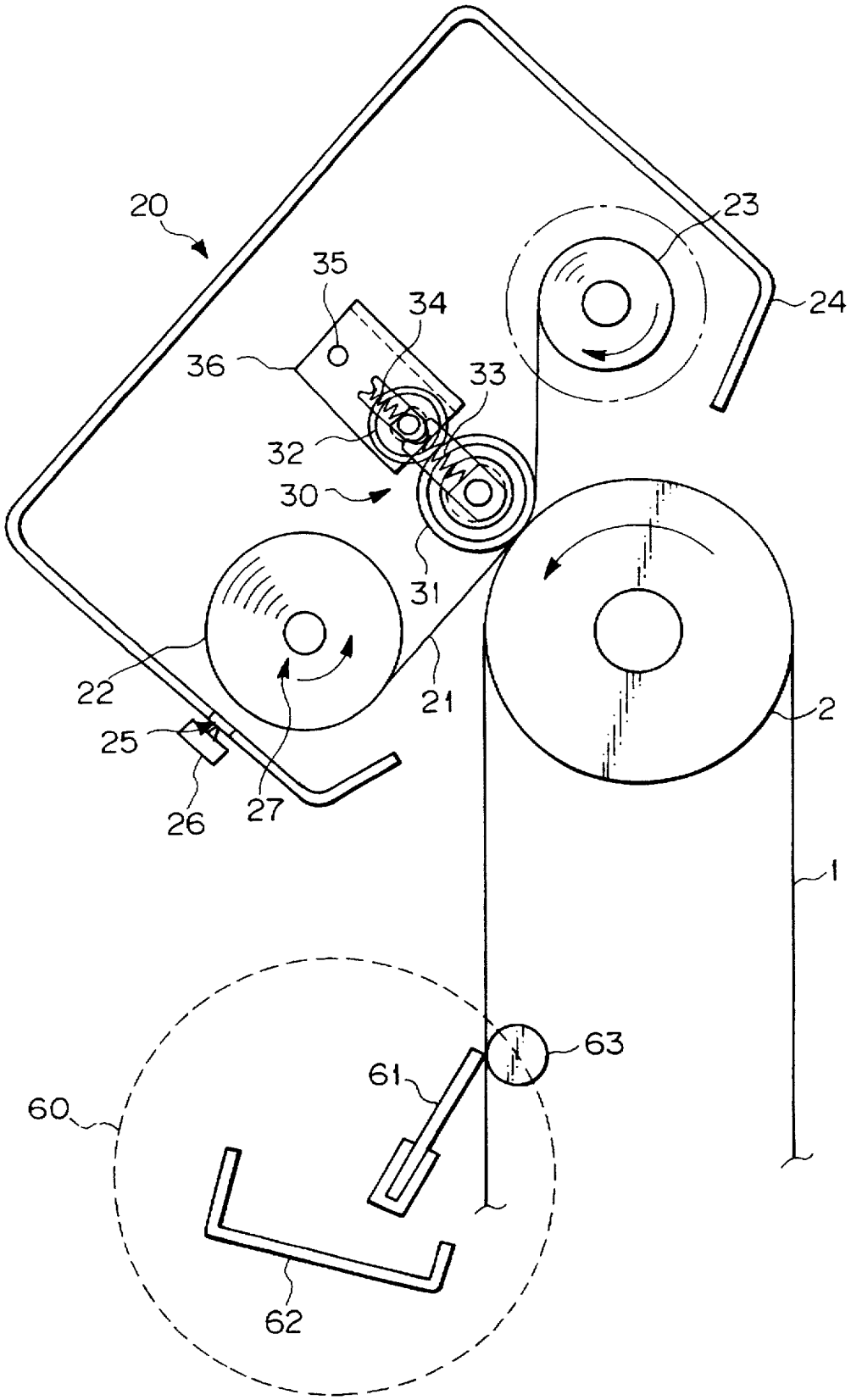
FIG. 22 shows a modification of the auxiliary cleaning device in a condition wherein a blade is held in contract with a conveyor belt.

As shown in FIG. 22, the auxiliary cleaning device 50 may be replaced with an auxiliary cleaning device 60. As shown, the cleaning device 60 has a blade 61 contacting the belt 1 at its edge in the direction counter to the direction of conveyance. A tray 62 is positioned below the blade 61. A back-up roller 63 urges the belt 1 against the blade 61. The auxiliary cleaning device 60 is also located downstream of the main cleaning device 20. While the belt 1 is in movement, the blade 61 scrapes off the developer returned from the webbing 21 to the belt 1. The developer removed by the blade 61 is received by the tray 62.

The tray 62 collected the removed developer should only be periodically removed from the copier in order to discard the developer. By contrast, the felt 52 must be replaced when it has collected a certain amount of the developer. The cleaning device 60 therefore does not need the replacement of parts and can be used over a long period of time.

In the sixth embodiment, it is when the liquid developer deposits on the belt 1 in a great amount after image formation that the developer is returned from the webbing 21 to the belt 1. The return of the developer to the belt 1 is apt to occur when the conveyance of the sheet 5 is defective. The auxiliary cleaning device 60 may therefore clean the belt 1 only when an error occurs in the conveyance of the sheet 5. This can be done if moving means for moving the blade 61 into and out of contact with the belt 1 is provided, as follows.

Figure 23:
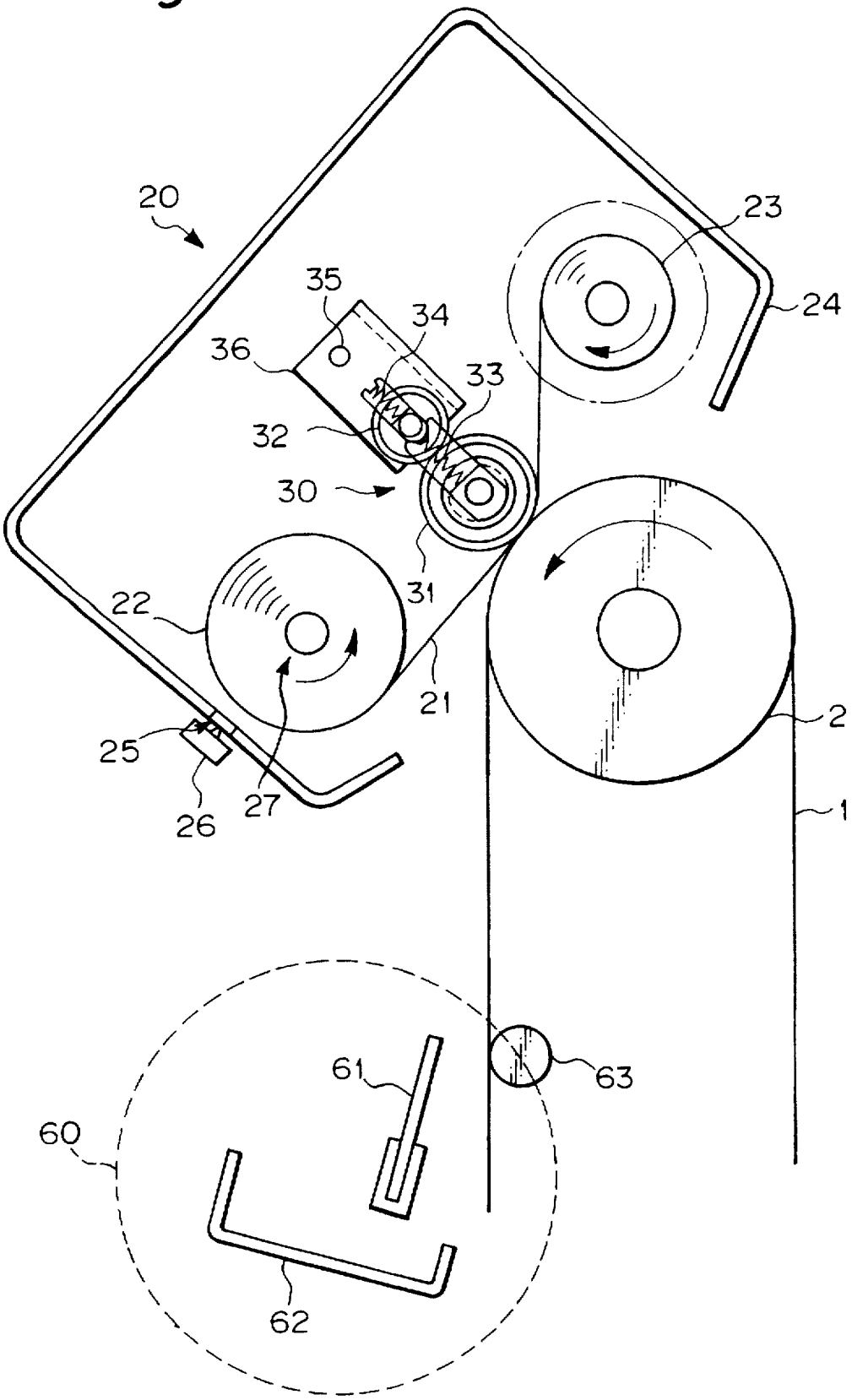
FIG. 23 shows the auxiliary cleaning device in a condition wherein the blade is spaced from the conveyor belt.
Figure 24:
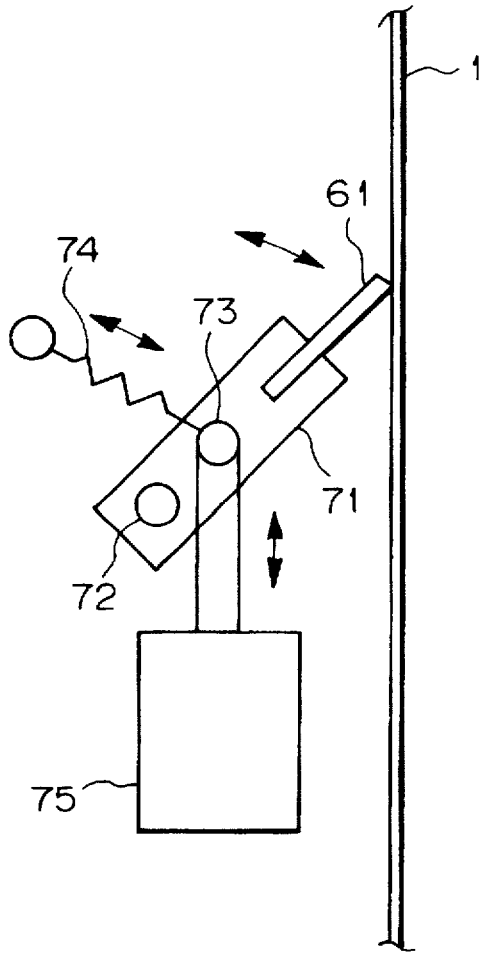
FIG. 24 shows a specific mechanism for moving the blade into and out of contact with the conveyor belt.

FIG. 23 shows a condition wherein the blade 61 of the auxiliary cleaning device 60 is spaced from the belt 1. FIG. 24 shows a specific mechanism for selectively moving the blade 61 into or out of contact with the belt 1. As shown in FIG. 24, the mechanism includes a bracket 71 supporting the blade 61 and constructed integrally with the blade 61. The bracket 71 is rotatably mounted on a shaft 72 at its end remote from the blade 61. A spring 74 is anchored at one end at a position above the bracket 71 and at the other end to the substantially intermediate portion 73 of the bracket 71, constantly biasing the bracket 71 away from the belt 1. A solenoid or drive source 74 has its plunger connected to the center 73 of the bracket 71 in order to pull the bracket 71 downward against the action of the spring 74. When the solenoid 57 is turned off, the blade 61 is rotated about the shaft 72 counterclockwise, as viewed in FIG. 24, away from the belt 1 by the force of the spring 74. When the solenoid 75 is turned on, it causes the bracket 71 to rotate clockwise until the blade 61 contacts the belt 1. When the bracket 71 rotates counterclockwise excessively, it is likely that the spring 74 comes off the bracket 71. This can be obviated if a stop, not shown, is provided.

During usual image formation, the blade 61 is spaced from the belt 1. When the first sensor 40 or the second sensor 41 senses defective conveyance, the above moving mechanism brings the blade 61 into contact with the belt 1 and causes it to scrape off the developer from the belt 1. When the usual image forming condition is restored, the mechanism again moves the blade 61 away from the belt 1. In this manner, the blade 61 is not constantly held in contact with the belt 1, but it contacts the belt 1 only when the conveyance is defective, i.e., when the transfer of the developer from the webbing 21 to the belt 1 is apt to occur. This frees the belt 1 and blade 61 from deterioration ascribable to the continuous contact of the belt 1 and blade 61. In addition, because the blade 61 does not contact the belt 1 during image formation, it has no influence on the drive of the belt 1 and eliminates images with jitter.

The auxiliary cleaning device 60 may clean the belt 1 at a position close to, but downstream of, the position where the main cleaning device 20 cleans the belt 1. Then, the cleaning device 60 can remove the developer just after the developer has been returned from the webbing 21 to the belt 1 at the cleaning device 20. This prevents the developer from flying about in the copier while the belt 1 is in movement.

In summary, it will be seen that the present invention provides an image forming apparatus and a cleaning device therefor having various unprecedented advantages, as enumerated below.

(1) The portions of a webbing corresponding to the projections of a presser member have an edge-like configuration each and surely peel off a strain firmly adhered to a surface to be cleaned. Therefore, there can be eliminated the contamination of the rear of a sheet and defective image transfer. When the webbing becomes saturated with collected stains, it is paid out in order to bring its fresh portion to the surface to be cleaned. At this instant, the presser member rotates due to the conveyance of the webbing, so that the webbing can be conveyed with the presser member abutting against the above surface. This promotes smooth cleaning operation.

(2) Two or more of the edge-like portions of the webbing are present in a range over which the webbing is pressed against the surface to be cleaned, in the direction in which the webbing and the surface move relative to each other. In this configuration, a stain which a certain edge-like portion has failed to peel off can be peeled off by the next edge-like portion. This further enhances the cleaning ability. If desired, the projections of the presser member may each be divided in the direction perpendicular to the above direction, so long as each has at least two projections.

(3) The presser member is implemented as a metallic member having a knurled surface. The projections are therefore provided with high rigidity. This allows the webbing to form the edge-like portions and surely wipe off stains even when it is relatively thick. Knurling is a conventional easy technology and therefore does not complicate the production of the presser member. Moreover, because knurling is capable of forming the projections accurately, the projections contact the surface uniformly and further promote sure cleaning.

(4) The rotation of the presser member is regulated such that the surface of the presser member contacting the webbing does not move in the direction opposite to the above direction. This prevents the webbing from being conveyed in the reverse direction. Consequently, the portion of the webbing absorbed stains is prevented from again contacting the surface to be cleaned and returning to it.

(5) The cleaning operation is controlled in accordance with the varying operating condition of the copier. Therefore, when the degree or the kind of contamination of the belt is irregular due to the varying operation condition of the copier, the toner and others deposited on the belt can be removed in the optimal manner. This insures desirable cleaning at all times and thereby obviates the contamination of the rear of a sheet and defective image transfer.

(6) At the start-up stage following power-up, cleaning is effected a greater number of times than during usual image formation. Therefore, stains (deposits) firmly adhered to the belt while the power switch was turned off can be surely removed.

(7) At the time of recovery from an error, the portion of the webbing pressed against the surface to be cleaned is replaced more often than during usual image formation. Therefore, even when the liquid developer is deposited in a great amount on the surface of the belt, the belt can be cleaned by the dry part of the webbing. This surely removes the liquid ascribable to the developer from the belt. Specifically, when an arrangement is made such that the cleaning portion of the webbing is replaced by a preselected amount at a preselected timing, the amount of replacement is increased at each replacing timing. On the other hand, when an arrangement is so made as to continuously replace the cleaning portion during cleaning, the amount of replacement for a unit time is increased. It is to be noted that the recovery from an error refers to recovery from, e.g., a condition wherein after a jam sensor has sensed a jam, the power supply of the apparatus is forcibly turned off due to some trouble.

(8) After a control image transferred from the image carrier to the belt has been moved away from the cleaning position, the cleaning portion of the webbing contaminated by the control image is replaced. Therefore, the webbing prepares the belt for the next image formation before the next cleaning operation.

(9) At the time of recovery from an error, the webbing contacts the surface to be cleaned with a greater force than during usual image formation, enhancing the cleaning ability. Therefore, even when the liquid deposits on the belt in a great amount, it can be desirably removed. Only at the time of recovery from an error, e.g., jam to be effected after the detection of defective conveyance, the contact force of the webbing is increased. This prevents the drive of the belt from being degraded during usual image formation and thereby obviates jitter and other defects on images. Because the period of time necessary for the recovery from an error is far shorter than the duration of image formation, the webbing does not deteriorate the belt even when strongly pressed against the belt at the time of recovery.

(10) Auxiliary cleaning means again cleans the surface of the belt having been cleaned by the webbing or main cleaning means. This prevents deposits from flying about in the apparatus more positively while obviating defective image transfer to a recording medium.

(11) A blade contacts the surface of the belt having been cleaned by the webbing while a tray collects deposits scraped off by the blade. The deposits collected by the tray is periodically discarded. This allows the blade and tray to be used over a long period of time without any replacement. Therefore, the time and labor for replacing the parts of the auxiliary cleaning means and the cost of parts are saved.

(12) Moving means moves the blade into contact with the belt at the time of recovery from an error or moves it away from the belt during usual image formation. This reduces the duration of contact of the belt and blade and thereby prevents the life of the belt and that of the blade from being reduced due to wear. Because the blade is spaced from the belt at the time of usual cleaning during image formation in order to protect the drive of the belt from deterioration during image formation. This obviates jitter and other defects on images.

(13) The operation of the cleaning device is controlled on the basis of the degree of contamination sensed by contamination sensing means. This eliminates the contamination of the rear of a recording medium and defective image transfer.

(14) The relative movement of the belt and the webbing is continued until the output of the contamination sensing means indicates a degree of contamination below a preselected degree. Therefore, cleaning can be executed in matching relation to the actual degree of contamination.

(15) When the output of the contamination sensing means appearing during image formation indicates a degree of contamination above a preselected degree, the image formation is interrupted, and then cleaning is effected. Therefore, even when the belt is contaminated due to an unexpected occurrence, the contamination can be dealt with immediately. Assume that after the image formation has interrupted, the output of the contamination sensing means indicates a degree of contamination below the preselected degree during cleaning. Then, the image formation is resumed. This allows image formation to be resumed smoothly after the unexpected occurrence.

Various modifications will become possible for those skilled in the art after receiving the teachings of the present disclosure without departing from the scope thereof.

What is claimed is:

1. A cleaning device for cleaning a desired surface, comprising:

a webbing pressed against the desired surface and movable relative to the desired surface; and a presser member for pressing said webbing against the desired surface with a contact surface of said presser member, wherein said presser member comprises a plurality of projections each extending in a direction perpendicular to a direction in which the desired surface and said webbing move relative to each other said projections including edge portions at ends of said projections contacting said webbing, and wherein at least two of said plurality of projections are arranged in said direction in a cleaning range, wherein said cleaning range is an area over which said projections press said webbing against the desired surface.

2. A device as claimed in claim 1, further comprising regulating means for regulating rotation of said presser member such that said contact surface of said presser member does not move in a direction opposite to a preselected direction.

3. A device as claimed in claim 1, wherein said presser member comprises a metallic member having a knurled peripheral surface.

4. A device as claimed in claim 3, further comprising regulating means for regulating rotation of said presser member such that said contact surface of said presser member does not move in a direction opposite to a preselected direction.

5. A cleaning device for cleaning a desired surface, comprising:

a webbing pressed against the desired surface and movable relative to the desired surface;

a rotatable presser member in a form of a roller having ridges on an outer periphery thereof, said presser member pressing said webbing against the desired surface with said outer periphery, wherein said ridges comprising a plurality of projections each extending in a direction perpendicular to a direction in which the desired surface and said webbing move relative to each other, said projections including edge portions at ends of projections contacting said webbing, and wherein at least two of said plurality of projections are arranged in said direction in a cleaning range, wherein said cleaning range is an area over which said projections press said webbing against the desired surface; and a conveying mechanism for conveying said webbing.

6. A device as claimed in claim 5, further comprising regulating means for regulating rotation of said presser member such that the outer periphery of said presser member does not move in a direction opposite to a preselected direction.

7. A device as claimed in claim 5, wherein said presser member comprises a metallic member having a knurled peripheral surface.

8. A device as claimed in claim 7, further comprising regulating means for regulating rotation of said presser member such that said contact surface of said presser member does not move in a direction opposite to a preselected direction.

9. An image forming apparatus comprising:

a conveyor belt for conveying a recording medium to which a toner image is to be transferred from an image carrier, to an image transfer position facing a surface of said image carrier; and a cleaning device for cleaning a surface of said conveyor belt;

said cleaning device comprising:

a webbing pressed against said surface of said conveyor belt and movable relative to said surface; and a presser member for pressing said webbing against said surface of said conveyor belt with a contact surface of said presser member, wherein said presser member comprises a plurality of projections each extending in a direction perpendicular to a direction in which the desired surface and said webbing move relative to each other, said projections including edge portions at ends of projections contacting said webbing, and wherein at least two of said plurality of projections are arranged in said direction in a cleaning range, wherein said cleaning range is an area over which said projections press said webbing against the desired surface.

10. An image forming apparatus comprising:

a conveyor belt for conveying a recording medium to which a toner image is to be transferred from an image carrier, to an image transfer position facing a surface of said image carrier; and a cleaning device for cleaning a surface of said conveyor belt;

said cleaning device comprising:

a webbing pressed against said surface of said conveyor belt and movable relative to said surface;

a rotatable presser member in a form of a roller having ridges on an outer periphery thereof, said presser member pressing said webbing against said surface of said conveyor belt with said outer periphery, wherein said ridges comprise a plurality of projections each extending in a direction perpendicular to a direction in which the desired surface and said webbing move relative to each other, said projections including edge portions at ends of projections contacting said webbing, and wherein at least two of said plurality of projections are arranged in said direction in a cleaning range, wherein said cleaning range is an area over which said projections press said webbing against the desired surface; and a conveying mechanism for conveying said webbing.

11. An image forming apparatus comprising:

a conveyor belt for conveying a recording medium to which a toner image is to be transferred from an image carrier, to an image transfer position facing a surface of said image carrier;

a cleaning device for cleaning a surface of said conveyor belt by pressing a webbing against said surface and based on relative movement of said surface and said webbing; and control means for controlling a cleaning operation of said cleaning device in accordance with an operating condition of said image forming apparatus, wherein said control means controls said cleaning device such that an initial stage of operation of said apparatus following power-up, said cleaning device cleans said surface of said conveyor belt a greater number of times than at a time of usual cleaning to occur during image formation.

12. An apparatus as claimed in claim 11, further comprising replacing means for replacing a portion of said webbing pressed against said surface, wherein said control means controls said replacing means such that said replacing means replaces said portion of said webbing more frequently at a time of recovery from an error than at a time of usual cleaning to occur during image formation.

13. An apparatus as claimed in claim 11, further comprising:

replacing means for replacing a portion of said webbing pressed against said surface; and control image forming means for forming on said image carrier a control image for controlling an image forming process;

wherein said control means controls said replacing means such that said replacing means replaces said portion of said webbing after said control image formed on said image carrier and then transferred to said conveyor belt has moved away from a cleaning position where said webbing is located.

14. An image forming apparatus comprising:

a conveyor belt for conveying a recording medium to which a toner image is to be transferred from an image carrier, to an image transfer position facing a surface of said image carrier;

a cleaning device for cleaning a surface of said conveyor belt by pressing a webbing against said surface and based on relative movement of said surface and said webbing; and control means for controlling a cleaning operation of said cleaning device in accordance with an operating condition of said image forming apparatus wherein said control means causes, at a time of recovery from an error, said webbing to contact said surface with a greater force than at a time of usual cleaning to occur during image formation.

15. An apparatus as claimed in claim 14, further comprising auxiliary cleaning means located downstream of a cleaning position assigned to said webbing with respect to a direction of movement of said conveyor belt, for again cleaning said surface having been cleaned.

16. An apparatus as claimed in claim 15, wherein said auxiliary cleaning means comprises a blade contacting said surface, and a tray for collecting a substance removed from said surface by said blade.

17. An apparatus as claimed in claim 16, further comprising:

moving means for selectively moving said blade toward or away from said surface; and control means for controlling said moving means such that said moving means said blade into contact with said surface of said conveyor belt at a time of recovery from an error and moves said blade out of contact with said surface at a time of usual cleaning to occur during image formation.

18. An image forming apparatus comprising:

a conveyor belt for conveying a recording medium to which a toner image is to be transferred from an image carrier, to an image transfer position facing a surface of said image carrier;

a cleaning device for cleaning a surface of said conveyor belt by pressing a webbing against said surface and based on relative movement of said surface and said webbing;

sensing means for sensing a degree of contamination of said surface; and control means for controlling said cleaning device on the basis of the degree of contamination sensed by said sensing means, wherein said control means causes said sensing means to sense the degree of contamination at an initial stage of operation of said apparatus following power-up, and causes said surface if said conveyor belt and said webbing to move relative to each other until an output of said sensing means indicates a degree of contamination below a preselected degree.

19. An image forming apparatus comprising:

a conveyor belt for conveying a recording medium to which a toner image is to be transferred from an image carrier, to an image transfer position facing a surface of said image carrier;

a cleaning device for cleaning a surface of said conveyor belt by pressing a webbing against said surface and based on relative movement of said surface and said webbing;

sensing means for sensing a degree of contamination of said surface; and control means for controlling said cleaning device on the basis of the degree of contamination sensed by said sensing means wherein said control means causes said sensing means to sense the degree of contamination during image formation, and interrupts, when the degree of contamination is above a preselected degree, the image formation, causes said cleaning device to clean said surface of said conveyor belt, and again causes said sensing means to sense the degree of contamination during cleaning, and resumes the image formation when the degree of contamination decreases below said preselected degree.

* * * * *